US006122609A

United States Patent [19]

Scalart et al.

[11] Patent Number: 6,122,609

[45] Date of Patent: Sep. 19, 2000

[54] METHOD AND DEVICE FOR THE OPTIMIZED PROCESSING OF A DISTURBING SIGNAL DURING A SOUND CAPTURE

[75] Inventors: Pascal Scalart, Ploubezre; André Gilloire, Lannion, both of France

[73] Assignee: France Telecom, Paris, France

[21] Appl. No.: 09/093,740

[22] Filed: Jun. 8, 1998

[30] Foreign Application Priority Data

Jun. 9, 1997 [FR] France ..... 97 07106

[51] Int. Cl.[7] ..... G10L 21/00

[52] U.S. Cl. ..... 704/226; 227/233

[58] Field of Search ..... 704/226, 227, 704/233

[56] References Cited

U.S. PATENT DOCUMENTS

| | | | |
|---|---|---|---|
| 4,630,305 | 12/1986 | Borth et al. | 704/226 |
| 5,012,519 | 4/1991 | Adlersberg et al. | 381/47 |
| 5,485,524 | 1/1996 | Kuusama et al. | 704/232 |
| 5,706,395 | 1/1998 | Arslan et al. | 704/232 |
| 5,757,937 | 5/1998 | Itoh et al. | 704/223 |
| 5,774,846 | 6/1998 | Morii | 704/232 |
| 5,943,429 | 8/1999 | Handel | 704/226 |

FOREIGN PATENT DOCUMENTS

| | | | |
|---|---|---|---|
| 2 305 831 | 4/1997 | United Kingdom | H04B 1/10 |
| WO 88/03341 | 5/1988 | WIPO | H04B 3/23 |

*Primary Examiner*—David R. Hudspeth
*Assistant Examiner*—Daniel Abebe
*Attorney, Agent, or Firm*—Marshall, O'Toole, Gerstein, Murray & Borun

[57] ABSTRACT

A method and a device adapted to hands-free mobile radiotelephony for the optimized processing of a disturbing signal during a sound capture, on the basis of an observation signal y(t) formed of an original useful signal s(t) and of this disturbing signal p(t), the disturbing signal is estimated as a signal p̂(t) and the useful signal as an estimated useful signal ŝu. An optimal filtering of the observation signal y(t) is carried out on the basis of the signal p̂(t) and of a minimizing of the error e(su,ŝu) between the useful signal su and the estimated useful signal ŝu. The estimated useful signal ŝu and the useful signal converge towards the original useful signal s(t) for a substantially zero error e(su,ŝu).

12 Claims, 9 Drawing Sheets

CONVENTIONAL PROCESSING OF A DISTURBING SIGNAL WITH N COMPONENTS

CONVENTIONAL HANDS-FREE MOBILE RADIO TELEPHONE PROCESSING

CONVENTIONAL TWO-SENSOR PROCESSING FOR VIDEO CONFERENCING (TIME DOMAIN)

(TIME DOMAIN)

FREQUENCY DOMAIN

FREQUENCY DOMAIN (BLOCKWISE FREQUENCY DOMAIN)

CONVENTIONAL PROCESSING BY ACOUSTIC ANTENNA TO REDUCE REVERBERATION

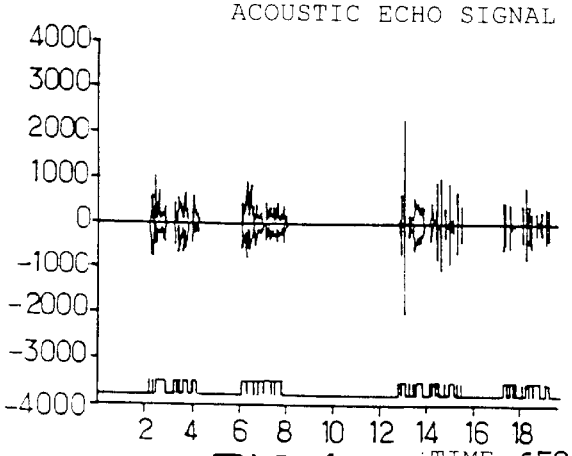
FIG 4a.
ORIGINAL ECHO SIGNAL
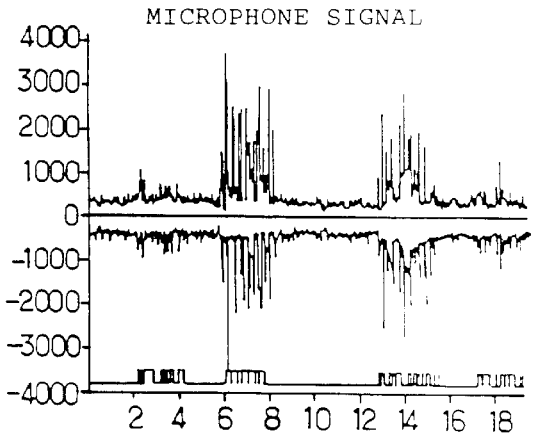
FIG.4b.
MICROPHONE SIGNAL
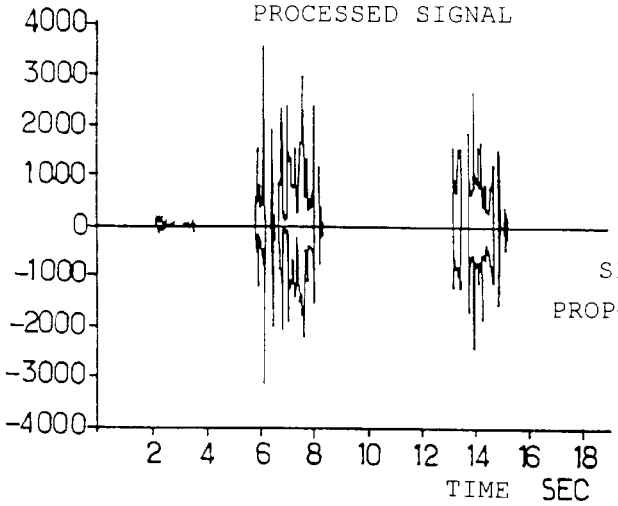
FIG.4c.
SIGNAL PROCESSED BY THE PROPOSED GLOBAL PROCESSING
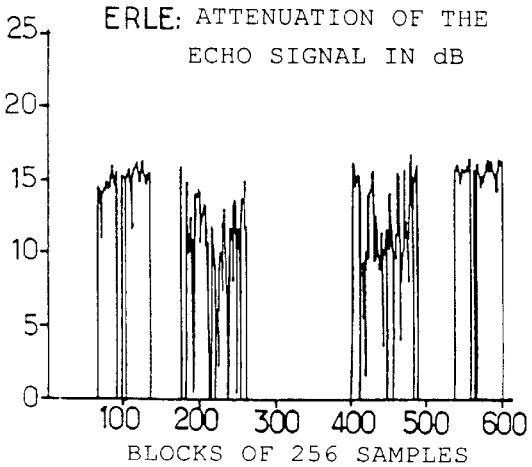
FIG.4d. ATTENUATION OF THE ECHO IN dB
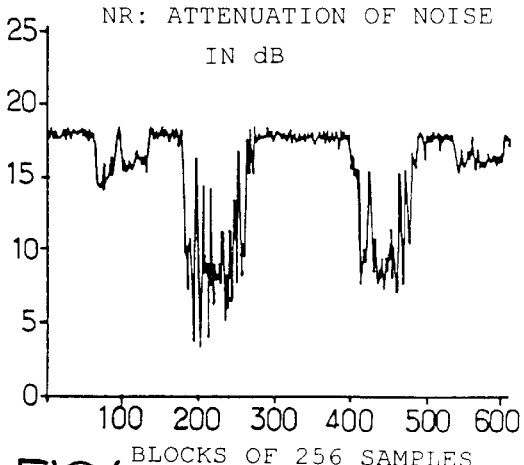
FIG.4e. ATTENUATION OF NOISE IN dB

METHOD AND DEVICE FOR THE OPTIMIZED PROCESSING OF A DISTURBING SIGNAL DURING A SOUND CAPTURE

The invention relates to a method and a device for the optimized processing of a disturbing signal during a sound capture.

With the joint advent of the era of information exchange, audio and/or videofrequency information, research engineers developing means for accessing this information are usually confronted, in most fields of application and use of this information, with the general problem of estimating a useful signal, carrying this information, from one or more observation signals composed of this useful signal degraded owing to the presence of disturbing signals.

In the more specific field of sound capture, these signals corresponding to audiofrequency signals, this problem is usually solved by concomitantly operating, jointly operating, several devices for processing this observation signal, each of these devices being optimized locally in such a way that the influence of a particular component of these disturbing signals or of at least one of these disturbing signals is significantly reduced at the level of one of these devices.

These conditions give rise to problems of interaction between these various devices and this of course makes it awkward to optimize the various processing operations applied. The modifying, in respect of optimization, of the control parameters of a particular device generally requires the mutual modifying of those of the other devices used.

Furthermore, the joint operating of these various devices leads to a non-optimized complexity of construction and generally to a high cost.

Various examples of the conventional solution which are known in the prior art will be given below in conjunction with FIGS. 1*a* to 1*d*. Generally, the observation signal y(t) may be regarded as the sum of the original useful signal s(t) and of a disturbing signal p(t) according to the relation:

$$y(t)=s(t)+p(t).$$

The disturbing signal may itself be regarded as the sum of N elementary components satisfying the relation:

$$p(t)=\sum_{k=1}^{N} p_k(t)$$

Figure 1A:
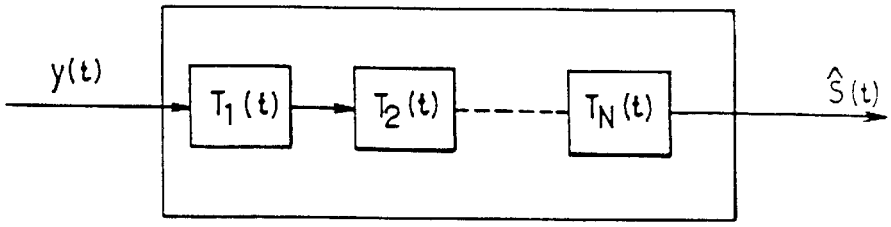
FIG. 1a (PRIOR ART)

As illustrated in FIG. 1*a*, a commonplace solution which is proposed in order to solve such a problem can consist in jointly operating a number N of devices, each of them being optimized and dedicated to the reduction, or even the local eliminat ion of a given component $p_k(t)$ of the disturbing signal.

Such an approach leads to the successive minimization of a local estimation error linked with each component of the disturbing signal. Each of these successive minimizations thus amounts to locally implementing a processing operation $T_k(t)$ adapted to the component $p_k(t)$ of the corresponding disturbing signal.

The general principle of processing, known as such and represented in FIG. 1*a*, is used in particular during hands-free sound capture within the mobile radio telephony context, and also within the video conferencing context.

Within the framework of applications related to hands-free radio telephony for mobiles, the disturbing signal p(t) may be regarded as composed of observation noise b(t), vehicle roadway noise, aerodynamic noise such as the wind, the flow of air, as well as of an acoustic echo signal z(t) originating from the acoustic coupling between the loudspeaker and the sound-capture microphone.

Figure 1B:
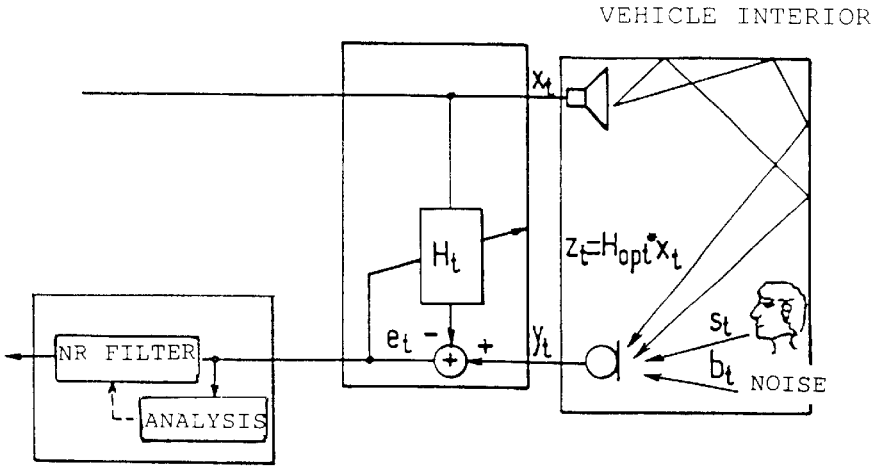
FIG. 1b (PRIOR ART)

With the aim of minimizing the influence of these two components of the disturbing signal and of transmitting a signal of higher quality to the distant party, current work and research have proposed the cascading of a noise reduction system and an acoustic echo control system. Such an association of systems is represented in FIG. 1*b*. The general principle of the solutions thus proposed consists in placing an NR filter noise reduction device downstream, as represented in FIG. 1*b*, or upstream of the acoustic cancellation device, the filter $H_r$. For a more detailed description of this type of device reference may usefully be made to the more recent articles published by:

- B. AYAD, G. FAUCON and R. LE BOUQUIN JEANNES, "*Optimization of a Noise reduction preprocessing in an acoustic echo and noise controller*", IEEE International Conference on Acoustics, Speech, and Signal Processing Conference, pp. 953–956, Atlanta, USA, May 7–10, 1996;
- Y. GUELOU, A. BENAMAR and P. SCALART, "*Analysis of two structures for combined acoustic echo cancellation and noise reduction*", IEEE International Conference on Acoustics, Speech, and Signal Processing Conference, pp. 637–640, Atlanta, USA, May 7–10, 1996;
- R. MARTIN, P. VARY, "*Combined acoustic echo control and noise reduction for hands-free telephony—State of the Art and perspectives*", proceedings of the Eighth European Signal Processing Conference, pp. 1127–1130, Trieste, Italy, Sep. 10–13, 1996.

Within the framework of applications related to video conferencing, the disturbing signal p(t) may be regarded as composed not only of an observation noise b(t) and of an acoustic echo signal z(t), but also of a signal r(t) generated by the reverberation effect of the room in which the sound capture is performed.

The solutions proposed, within such a context, may be classified into two main types, depending on whether the echo signal and the noise or else the noise and the reverberation are regarded as essentially detrimental.

In the two aforementioned cases, the solutions adopted correspond to the cascading of elementary processing operations, each of them being adapted to a particular component of the disturbing signal.

Figure 1C:
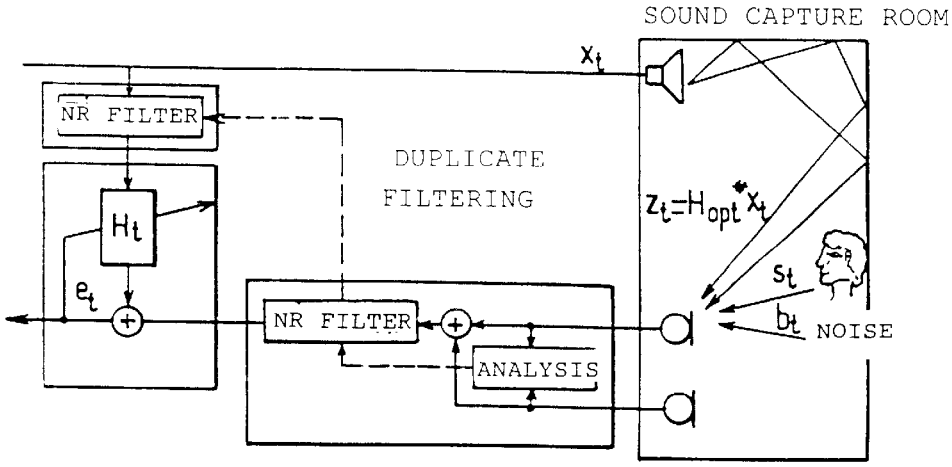
FIG. 1c (PRIOR ART)

According to the first type of these solutions, as represented in FIG. 1*c*, two elementary processing operations are implemented: an echo cancellation processing operation and a processing operation whose object is to reduce the influence of the noise, NR filter, on the useful signal. In the more particular case of FIG. 1*c*, in which two microphones are moreover employed to construct the sound-capture system, a duplicate of the NR filter is applied to the signal broadcast on the loudspeaker so as to reduce the influence of the non-linear variations of this filter on the echo signal identification procedure. For a more detailed description of the procedures for processing the noise and the echo reference may usefully be made to the article published by:

- R. MARTIN and P. VARY "*Combined acoustic echo cancellation, dereverberation and noise reduction: a two microphone approach*", Annales des télécommunications [*Telecommunications Annals*], Volume 49, No. 7-8, pp. 429–438, 1994.

Figure 1D:
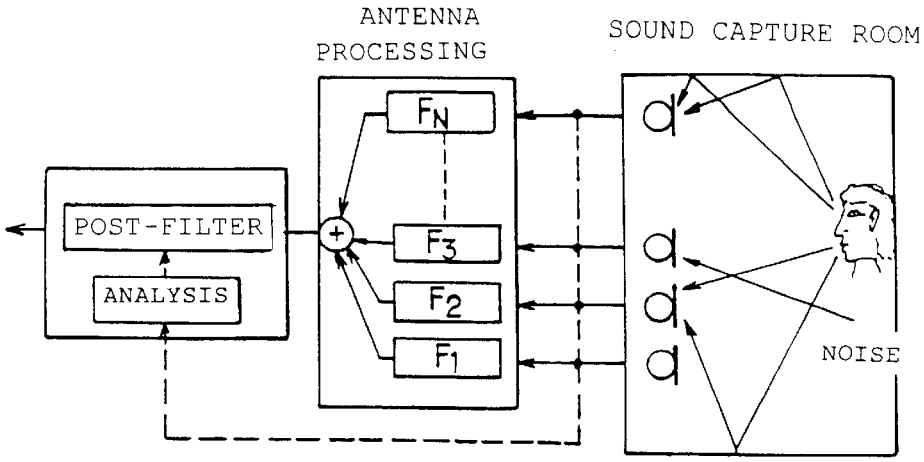
FIG. 1d (PRIOR ART)

According to the second type of these solutions, as represented in FIG. 1*d*, the sound capture can be carried out on the basis of a large number of microphones in such a way as to construct an acoustic antenna whose object is to focus the main lobe of the antenna on the talker and thus to favour the region of space in which the talker is actually situated so as to carry out a noise reduction and dereverberation operation. The acoustic antenna includes, in the conventional manner, a number of filters with bands $F_1$ to $F_N$ and a summator, carrying out antenna processing. Another post-filtering processing operation is applied at the output of the antenna and consists in reducing the surviving reverberation. For a more detailed description of this type of solution reference may usefully be made to the articles published by:

C. MARRO, Y. MAHIEUX and K. U. SIMMER, "*Performance on adaptive dereverberation techniques using directivity controlled arrays*", Proceedings of the Eighth European Signal Processing Conference, pp. 1127–1130, Trieste, Italy, Sep. 10–13, 1996;

K. U. SIMMER, S. FISHER and A. WASILJEFF, "*Suppression of coherent and incoherent noise using a microphone array*", Annales des télécommunications [*Telecommunications Annals*], Volume 49, No. 7-8, pp. 439–446, 1994.

In all the abovementioned solutions adopted, the cascading of these elementary processing operations, each of them being adapted to just one of the components of the disturbing signal, leads to a sub-optimal solution to the general problem of the rejection of the disturbing signal and, moreover, entails a considerable constructional cost. This is because, since each of these processing operations minimizes a local error, relating as it does to one elementary or local component of the disturbing signal, their association does not generally lead to the global minimum of the optimal solution.

Moreover, the practical implementation of each of these elementary processing operations constitutes merely an approximation of an ideal processing operation, distortions being introduced into the useful signal for each processing operation, from the point of view of the other processing operations, and this may ultimately lead to the input of the useful signal transmitted being strongly degraded relative to the original useful signal.

Finally, the cascading of these elementary processing operations necessitates investigation of the optimal position and the interaction of the various elementary processing operations, with respect to one another, so as to obtain the best configuration. However, it should be noted that the conclusions of such an investigation should be laid open to question depending on the choice of the procedures and algorithms used to run the various elementary processing operations. Such a constraint is described in the article published by Y. GUELOU, A. BENAMAR and P. SCALART, 1996, mentioned earlier, in the case of hands-free mobile telephony. The setting of the parameters, with a view to their adjustment, of the procedures and algorithms implemented then appears to be tricky, the modifying of a given parameter generally necessitating a corresponding modification of at least some parameters of the other elementary processing operations.

An a-posteriori optimization of these processing operations may, if appropriate, be envisaged. Such a mode of operation inevitably involves, on the one hand, a permanent exchange of information between these elementary processing operations and, on the other hand, the application of collective constraints on the parameters for adjusting them. Such an a-posteriori optimization of such systems has shown the limits of this approach by virtue of the results finally obtained.

The object of the present invention is to remedy the shortcomings and drawbacks of the prior art methods, procedures and systems described earlier.

Such an object is achieved by implementing a procedure for the a-priori optimization of the processing of the disturbing signal impairing any observation signal, this procedure being totally distinct, either from the prior art procedures described earlier in the description from any a-posteriori optimization of the aforementioned procedures.

The procedure for the a-priori optimization of the processing of a disturbing signal during a sound capture, on the basis of an observation signal formed of a original useful signal and of this disturbing signal is implemented by virtue of a method and a device consisting in performing, respectively making it possible to perform an estimation of the disturbing signal so as to generate an estimated disturbing signal. An estimation of the useful signal so as to generate an estimated useful signal and a filtering of the observation signal on the basis of the estimated disturbing signal and of an optimal filtering make it possible to minimize the error between the useful signal and the estimated useful signal. The estimated useful signal converges towards the original useful signal for a substantially zero error between the useful signal and the estimated useful signal.

The method and the device, which are the subject of the invention, find application to any context relating to sound capture, especially hands-free mobile telephony, hands-free video conferencing, and more generally studio operations or those in an audio control room.

Figure 2A:
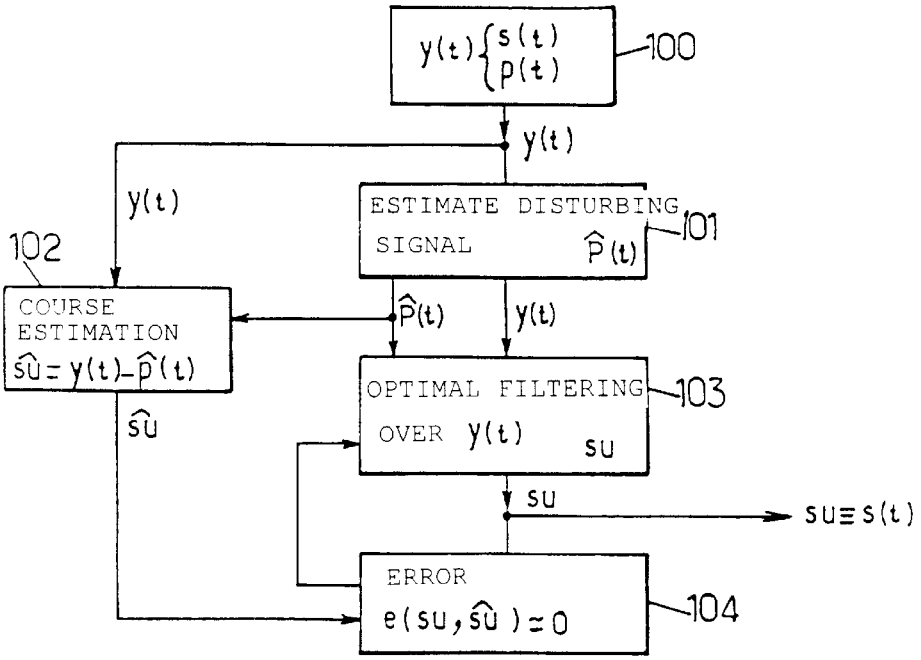
Figure 2B:
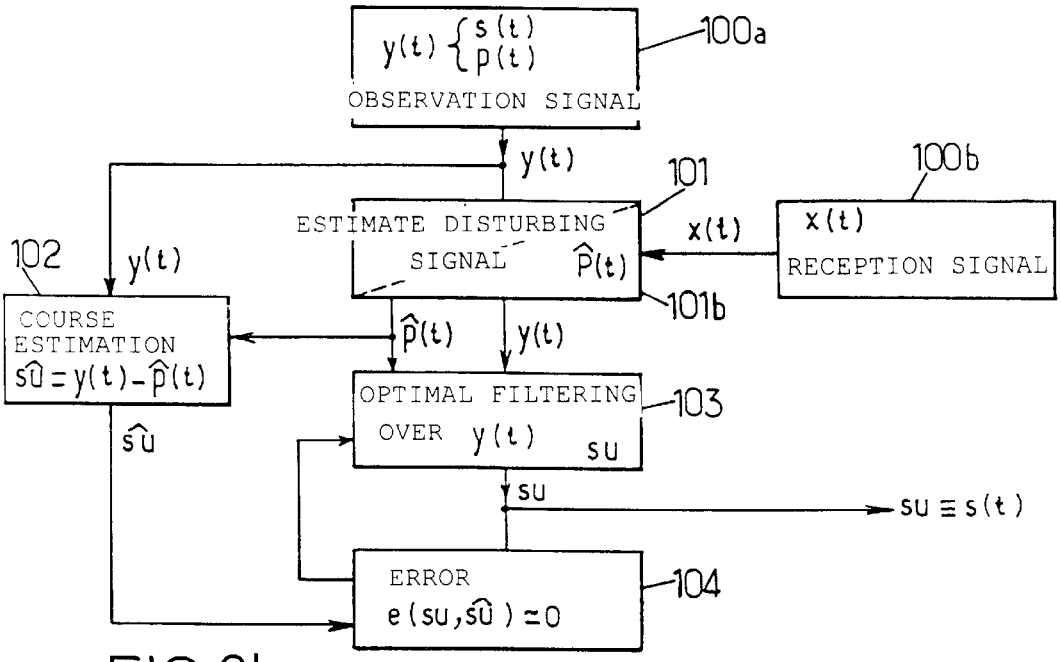
Figure 2C:
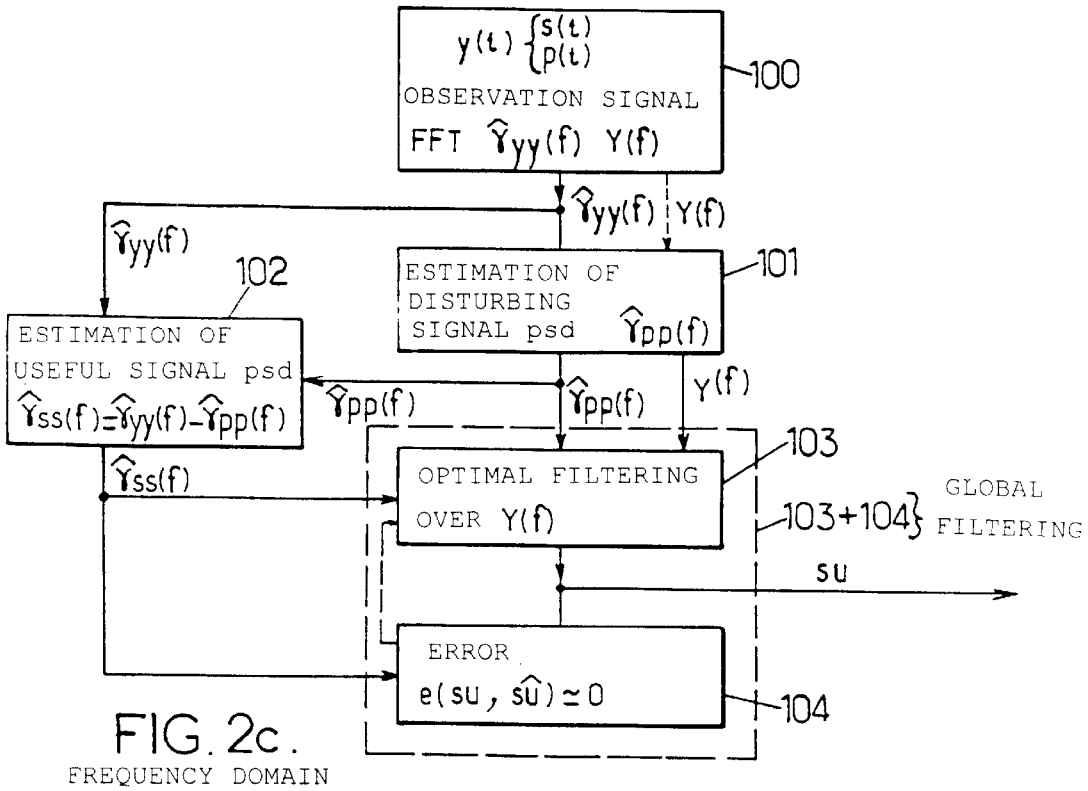
Figure 2D:
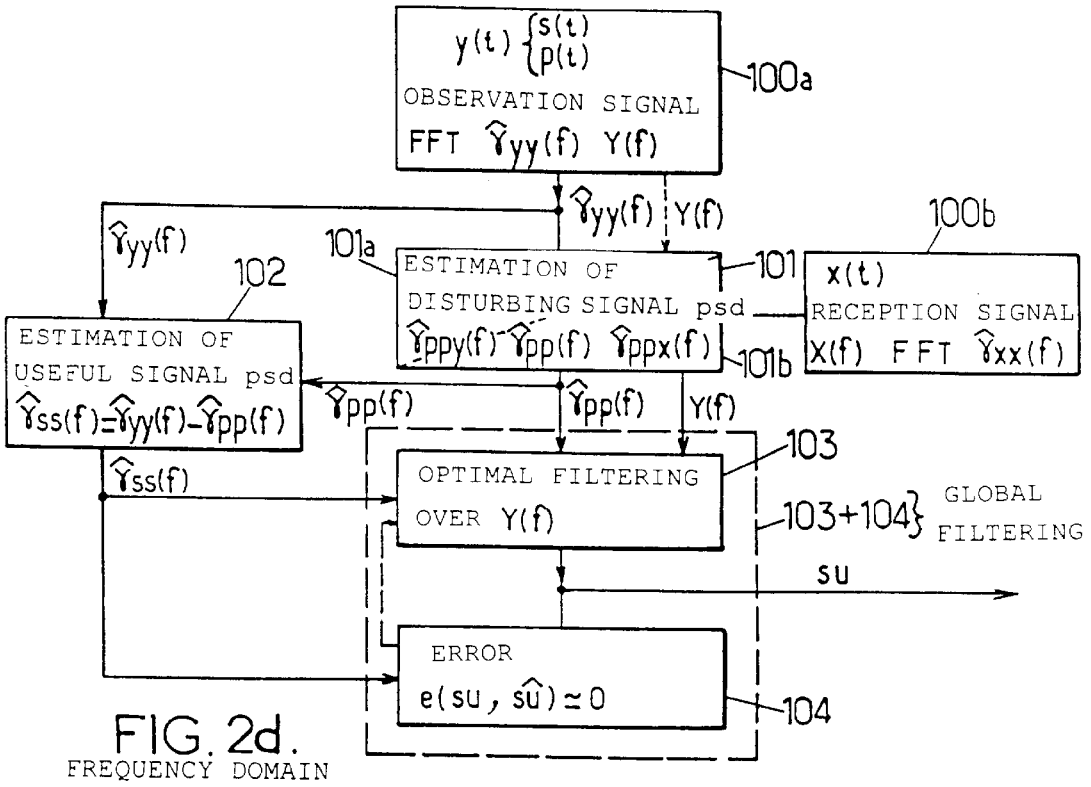
Figure 2E:
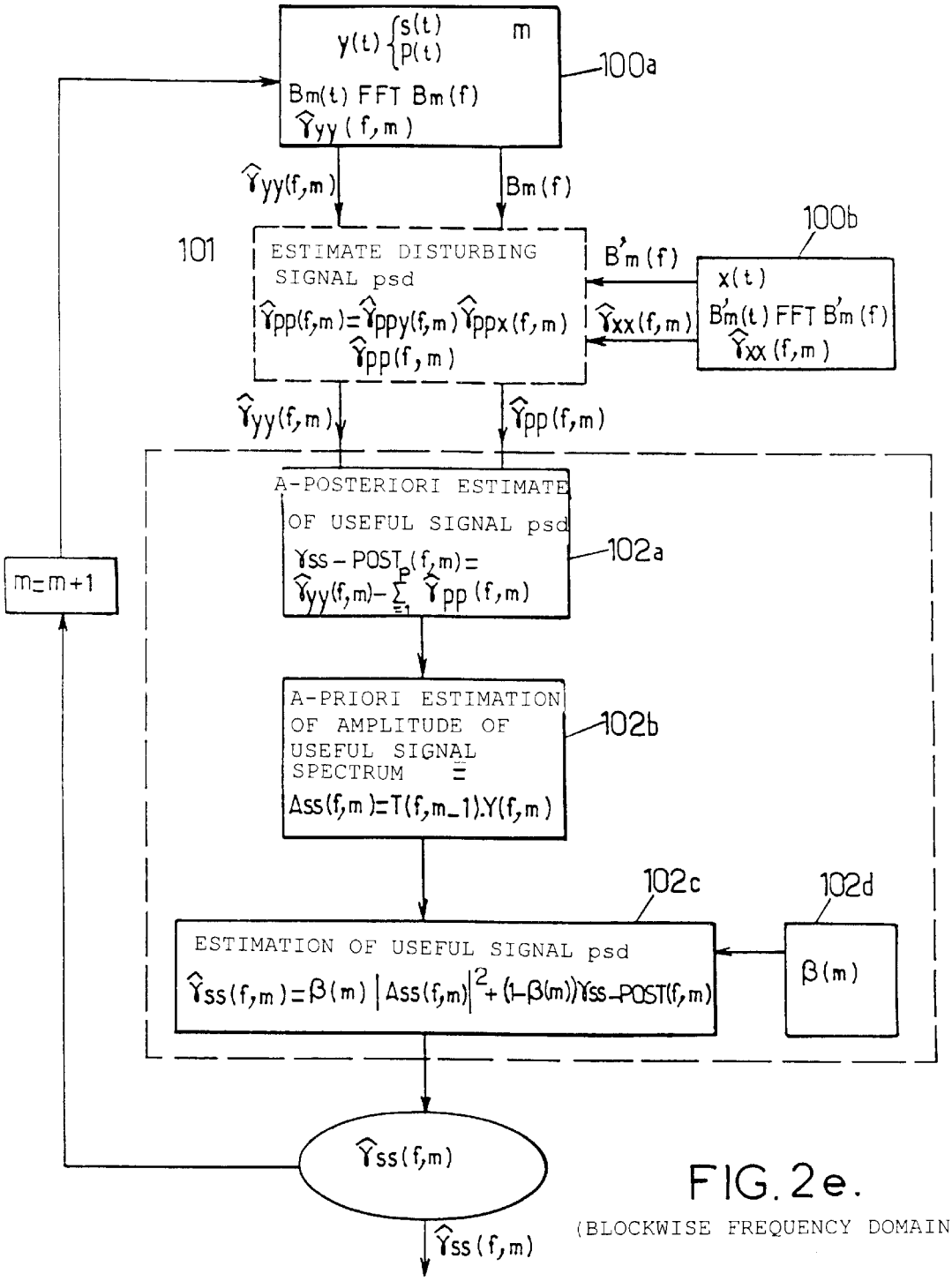
Figure 3A:
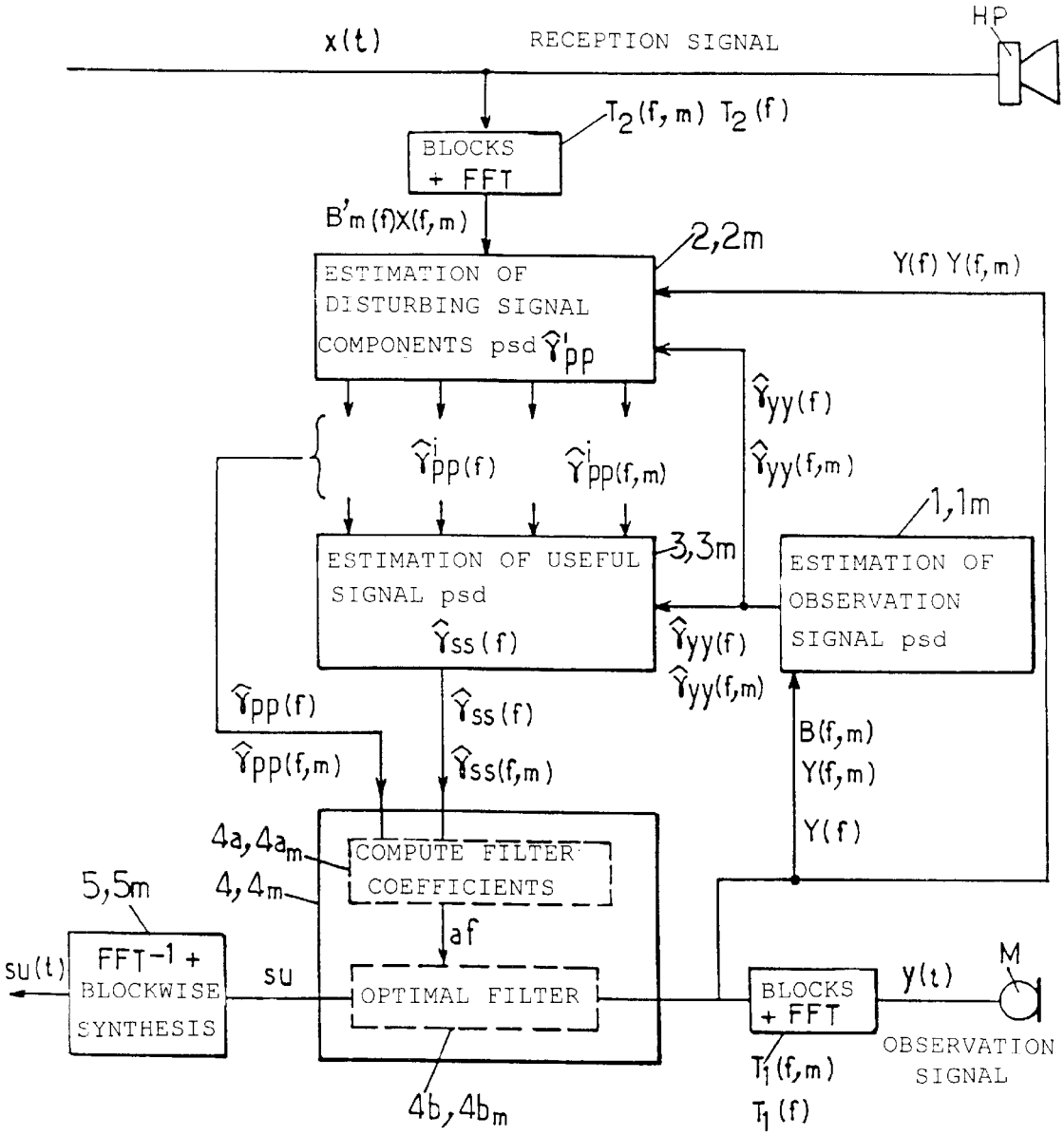
Figure 3B:
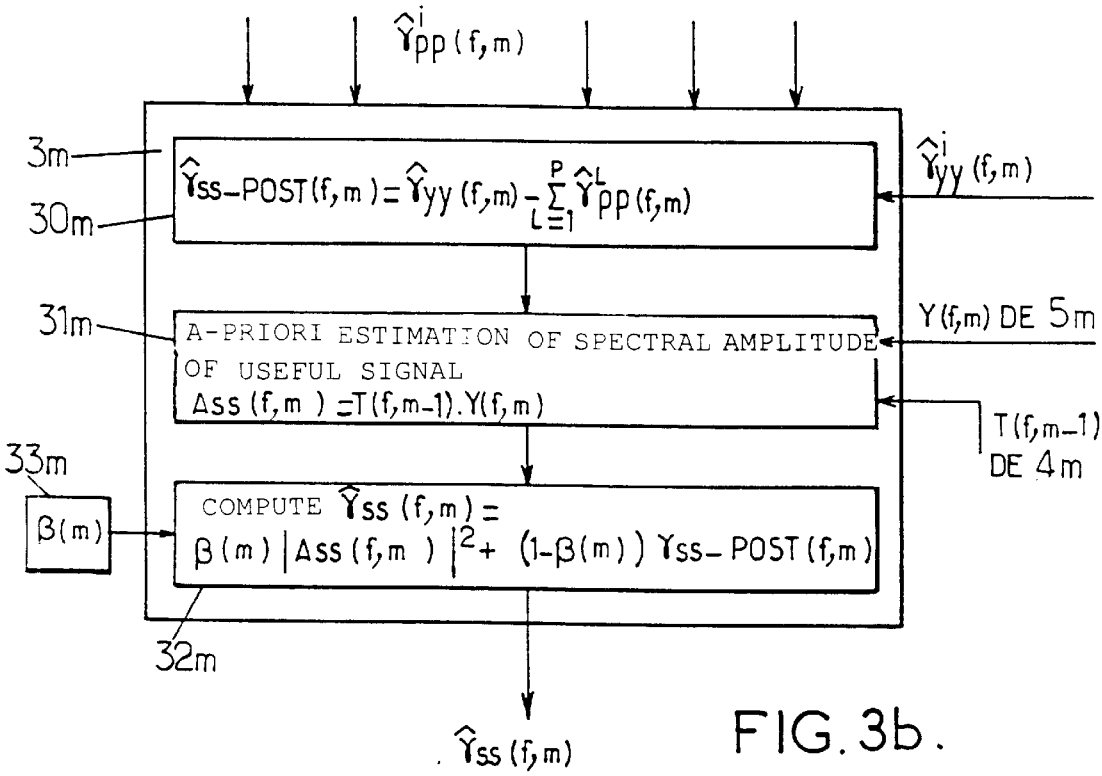
Figure 3C:
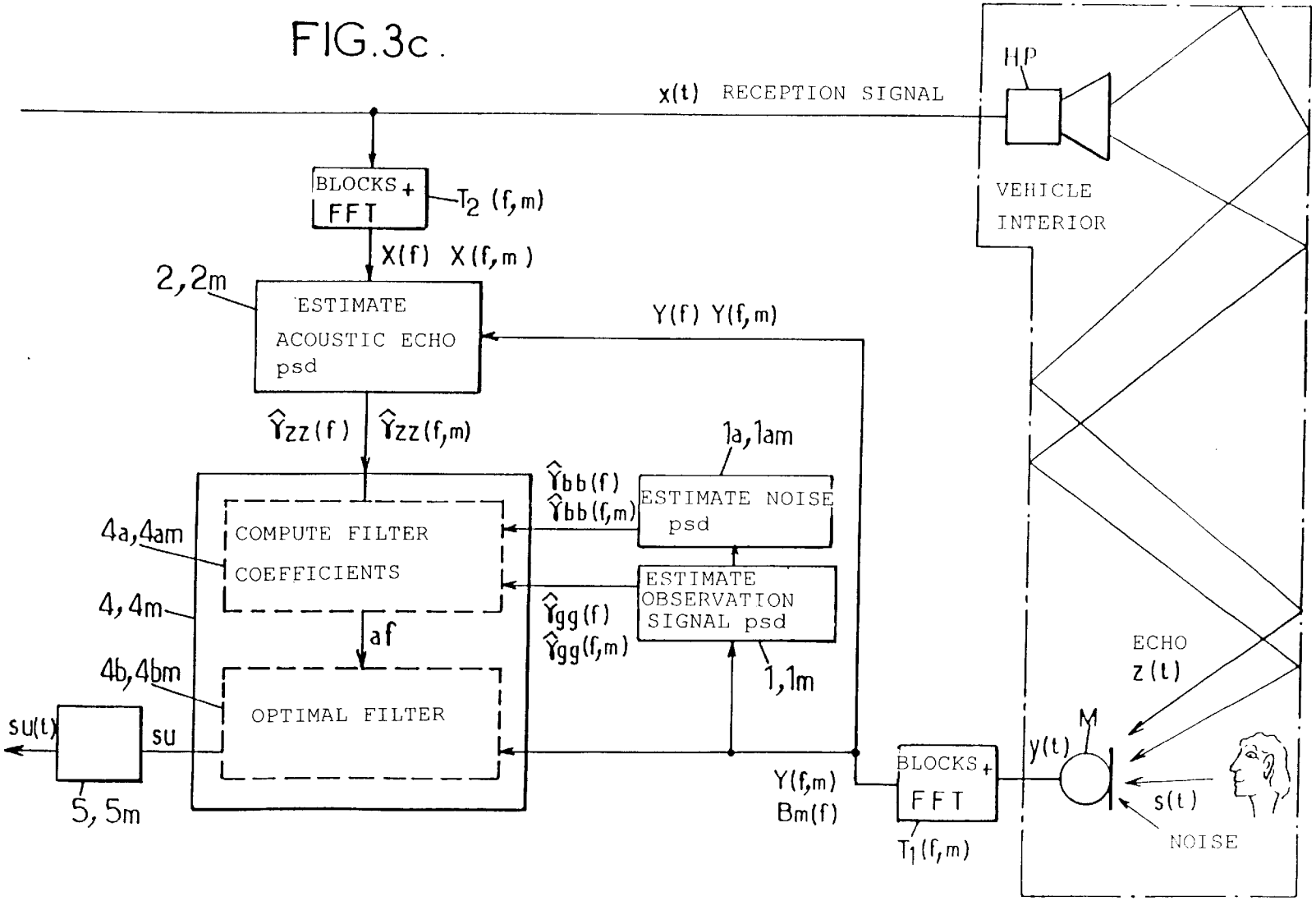
Figure 3D:
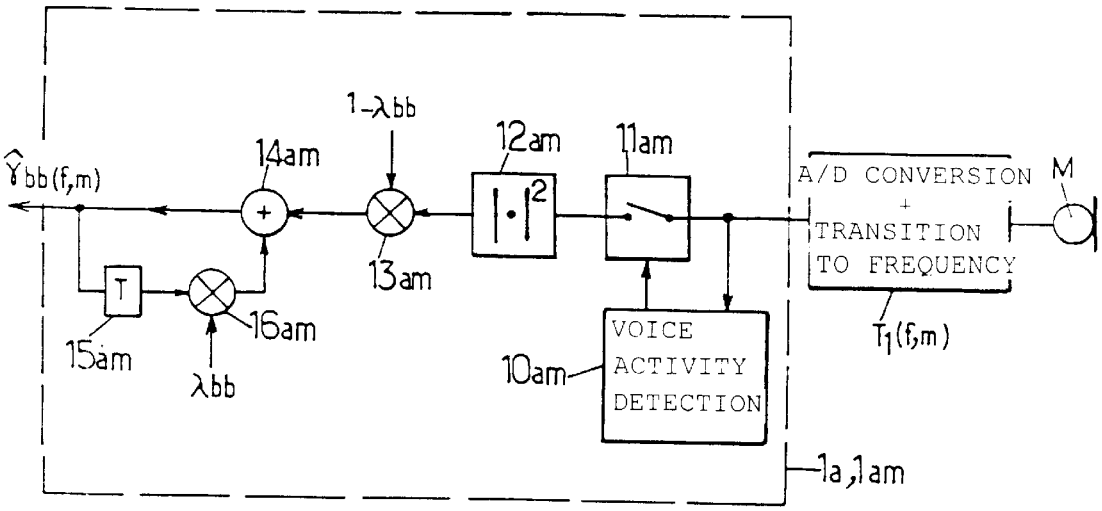
Figure 3E:
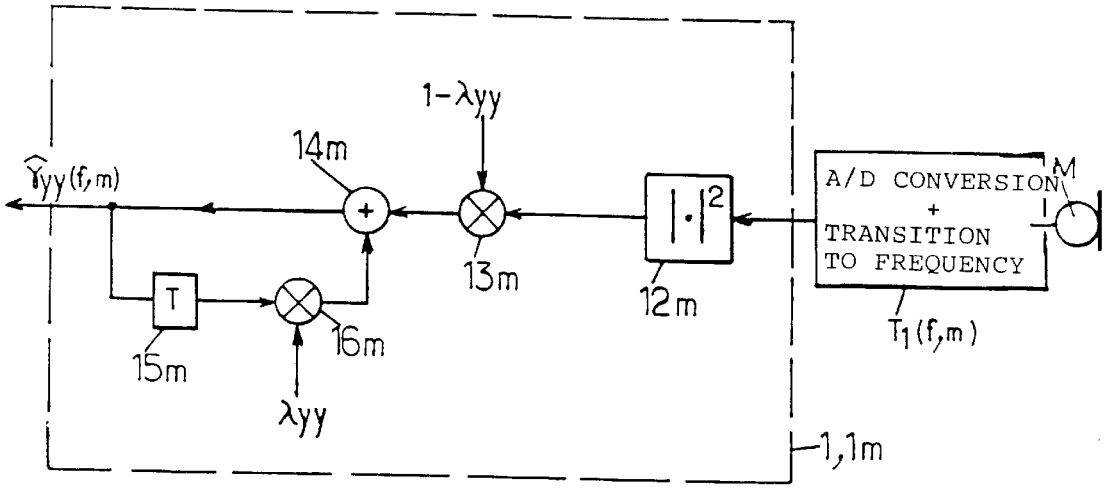

They will be better understood on reading the description and looking at the drawings below in which, apart from FIGS. 1*a* to 1*d* relating to the prior art, FIG. 2*a* represents, by way of non-limiting example, a block diagram illustrating the implementation of the method, which is the subject of the present invention in the time domain;

FIG. 2*b* represents, by way of non-limiting example, a block diagram illustrating the implementation of the method, which is the subject of the present invention, in the time domain, in the more particular case of the existence of a reception signal which generates an echo signal making a specific contribution to the disturbing signal;

FIG. 2*c* represents, by way of non-limiting example, in a situation similar to that of FIG. 2*a*, a block diagram illustrating the implementation of the method, which is the subject of the present invention, in the frequency domain;

FIG. 2*d* represents, by way of non-limiting example, a block diagram illustrating the implementation of the method, which is the subject of the present invention, in a situation similar to that of FIG. 2*b*, in the frequency domain, in the particular case of a reception signal which generates an echo signal making a specific contribution to the disturbing signal;

FIG. 2*e* represents, by way of non-limiting example, a block diagram illustrating a preferred implementation via successive block processing of a observation signal, in a situation similar to that of FIG. 2*d*, in the case of the existence of a reception signal which generates an echo signal making a specific contribution to the disturbing signal;

FIG. 3*a* represents, in the form of block diagrams, the schematic diagram of a device making possible, in the frequency domain, the general processing, respectively the processing in successive blocks, of the observation signal, in the general case of the existence of a reception signal which generates an echo signal making a specific contribution to the disturbing signal;

FIG. 3*b* represents an advantageous detail of an embodiment of a module for estimating the power spectral density of the useful signal more particularly implemented in the device represented in FIG. 3*a*, where, in particular, the block processing is implemented;

FIG. 3*c* represents a variant embodiment of the device represented in FIGS. 3*a* or 3*b*, in which a module for estimating the spectral density of the echo of a reception signal and a module for estimating the spectral density of the noise signal, in the context of an application to hands-free mobile radio telephony are introduced;

FIGS. 3*d* and 3*e* represent, by way of non-limiting example, a module for estimating the power spectral density of the noise signal and of the observation signal, by recursive filtering on the basis of a neglect factor;

FIGS. 4*a* to 4*e* represent various signal timing diagrams charted at noteworthy test points of FIG. 3*c* and making it possible to evaluate the performance of the method and of the device for the optimized processing of a disturbing signal, which is the subject of the present invention.

The method for the optimized processing of a disturbing signal during a sound capture, in accordance with the subject of the present invention, will now be described in conjunction with FIGS. 2*a* to 2*d*.

In general, it is indicated that the aforementioned disturbing signal consists at least of a noise signal which, precisely on account of the definition of a noise signal, is regarded as substantially uncorrelated with the original useful signal which it is desired to recover following attenuation, or even suppression, of this noise signal.

Firstly, it is indicated that the method for the optimized processing of the disturbing signal, which is the subject of the present invention, is performed on the basis of an observation signal, denoted y(t), available in a starting step 100 in FIG. 2*a*, this observation signal being supposedly formed of the original useful signal to be recovered, denoted s(t) and of the disturbing signal, denoted p(t).

More specifically, it is indicated that the disturbing signal, apart from the aforementioned noise signal, may include various contributions such as an echo signal, a reverberation signal or any other form of noise signal, as will be described later in the description. The framework of FIG. 2*a* is restricted to considering the existence of a noise signal which is substantially uncorrelated with the useful signal, as mentioned previously.

In accordance with the method, which is the subject of the present invention, this consists in performing an estimation in step 101 of the disturbing signal so as to generate an estimated disturbing signal denoted $\hat{p}(t)$. Of course, at the end of the aforementioned step 101 we have not only the estimated disturbing signal $\hat{p}(t)$, but also the previously mentioned observation signal y(t).

After obtaining the estimated disturbing signal $\hat{p}(t)$ in step 101, the optimized processing method, in accordance with the subject of the present invention, consists in performing, in a step 102, on the basis of the aforementioned observation signal y(t), coarse estimation of the useful signal, the estimated useful signal, by convention, being supposed, specifically on account of the non-correlation of the original useful signal and of the noise signal, to consist of the difference between the observation signal y(t) and the estimated disturbing signal $\hat{p}(t)$. At the end of step 102 we have an estimated useful signal, obtained following the coarse estimation step, this estimated useful signal corresponding approximately to the original useful signal s(t) and for this reason denoted $\hat{s}u$.

Following the aforementioned steps 101 and 102, the optimized processing method, which is the subject of the present invention, then consists in performing a filtering 103 of the observation signal y(t) on the basis of the estimated disturbing signal $\hat{p}(t)$ and of an optimal filtering so as to generate a useful signal denoted su.

As represented moreover in FIG. 2*a*, the optimal filtering 103 then makes it possible to minimize, in a step 104, the error between the estimated useful signal $\hat{s}u$ and the useful signal su. The complete procedure carried out by virtue of steps 103 and 104 via steps 101 and 102 then makes it possible to obtain convergence, by virtue of the optimal filtering, of the estimated useful signal $\hat{s}u$ and of the useful signal su towards the original useful signal s(t) for a substantially zero error between the useful signal su and the estimated useful signal $\hat{s}u$. The estimated useful signal $\hat{s}u$ or the useful signal su is then substantially equal to the original useful signal s(t) to within filtering errors.

FIG. 2*a* represents the method for the optimized processing of a disturbing signal, in accordance with the subject of the present invention, in the time domain. It is indicated in particular that the concepts of estimation of the disturbing signal, coarse estimation of the useful signal and optimal filtering can be defined perfectly in the time domain.

However, whereas in the case of FIG. 2*a* the observation signal y(t) supposedly includes just one disturbing signal p(t) formed by a single noise signal which is substantially uncorrelated with the useful signal, the method, which is the subject of the present invention, can also, in a particularly advantageous manner, be implemented when, with the aforesaid observation signal there corresponds a disturbing signal p(t) to which is added, in addition to the noise signal substantially uncorrelated with the original useful signal s(t), an echo signal denoted z(t). This echo signal corresponds, in particular in hands-free mobile telephony situations, for example to a disturbing signal generated by an observation signal, denoted x(t), under conditions which will be explained in greater detail later in the description.

Under these conditions, as represented in FIG. 2*b*, and again within the framework of optimized processing in the time domain, in accordance with the subject of the present invention, it is indicated that the estimating of the disturbing signal in step 101 advantageously consists in performing a separate estimation of the contribution 101*b* of this reception signal and of the contribution 101*a* of the noise signal to this disturbing signal.

The same notation as in the case of FIG. 2*a* is repeated in FIG. 2*b*, the estimated disturbing signal again being denoted $\hat{p}(t)$ and now consisting, not only of the contribution of the noise signal uncorrelated with the useful signal, in the same way as in the case of FIG. 2*a*, but also of the contribution to this disturbing signal of the reception signal denoted x(t).

By virtue of the non-correlation between the reception signal and the noise signal, according to a particularly advantageous aspect of the method, which is the subject of the present invention the procedure applied can then be substantially identical to that explained in conjunction with FIG. 2*a*.

For this same reason it is indicated that the estimated disturbing signal $\hat{p}(t)$ as well as the useful signal su play, in the optimal filtering procedure 103 and in the coarse estimation procedure 102, respectively in the procedure for computing the error and for minimizing this error 104, the same role as in the case of FIG. 2*a*.

Under these conditions, and for the same reasons, the useful signal su arising from the optimal filtering in step 103 converges towards the value of the estimated useful signal $\hat{s}u$ and, as a consequence, towards the value of the original useful signal s(t).

A preferred embodiment of the method for the optimized processing of a disturbing signal in the frequency domain corresponding to the case in which the disturbing signal p(t) consists simply of a noise signal uncorrelated with the useful signal s(t), respectively in the case in which, conversely, this disturbing signal consists, not only of the contribution of a noise signal uncorrelated with the useful signal, but also of the contribution of a reception signal x(t) such as an echo signal, a reverberation signal or the like actually generated by the observation signal y(t), will be given in conjunction with FIGS. 2*c*, respectively 2*d*.

This preferred embodiment is particularly advantageous by virtue especially of the fact that, within the framework of an implementation via the digital techniques of filtering in the frequency domain, it is not necessary to employ an echo canceller, unlike in the case of the techniques which it was possible to describe in conjunction with the prior art earlier in the description.

In conjunction with FIG. 2*c*, and in the case in which the disturbing signal p(t) is formed simply of a noise signal uncorrelated with the useful signal, the method of optimized processing, which is the subject of the present invention, in the frequency domain, can consist in performing in step 100 a frequency transform of the observation signal y(t) by means of a Fourier transform, such as a fast transform, denoted FFT in the usual manner, so as to make it possible to generate a transformed signal Y(f), this signal being representative, in the frequency domain, of the observation signal.

Moreover, the aforementioned step 100 consists in performing an estimation on the basis of the transformed signal Y(f) of a signal representative of the power spectral density of the observation signal, this signal being denoted $\hat{\gamma}_{yy}(f)$.

On completion of step 100 we thus have not only the transformed signal Y(f) representative of the frequency transform of the observation signal y(t), but also the signal representative of the estimated power spectral density of this observation signal, which signal is denoted $\hat{\gamma}_{yy}(f)$.

According to a particularly advantageous aspect of the implementation of the method for the optimized processing of a disturbing signal, which is the subject of the present invention, it is indicated that step 102 for estimating the useful signal can then be performed directly on the estimated power spectral density, on the one hand, of the observation signal $\hat{\gamma}_{yy}(f)$ and, on the other hand, of the signal representative of the estimated power spectral density of the disturbing signal obtained at the end of step 101, denoted $\hat{\gamma}_{pp}(f)$. In such a case, and in accordance with a noteworthy aspect of the method according to the invention, step 102 for coarse estimation of the useful signal then amounts to performing an a-posteriori estimation of the power spectral density of the useful signal, which, for this reason, is denoted $\hat{\gamma}_{ss}(f)$. At the end of step 102 we then have the signal representative of the estimated power spectral density of the aforementioned useful signal.

According to another particularly advantageous aspect of the method, which is the subject of the present invention, when the processing is performed in the frequency domain, as represented in FIG. 2*c*, the optimal filtering step 103 is carried out on the signal representative of the frequency transform of the observation signal Y(f) on the basis of the signals representative of the estimated power spectral density of the disturbing signal $\hat{\gamma}_{pp}(f)$ and of the signal representative of the estimated power spectral density of the useful signal, denoted $\hat{\gamma}_{ss}(f)$, which is available at the end of the aforementioned step 102. In this case, the optimal filtering step 103 and the step for computing the error and for minimizing this error 104 can be carried out by means of the same global filtering step, for this reason denoted 103+104 in FIG. 2*c*, the processing in the frequency domain, in particular the digital processing allowing, by virtue of the employing of a single optimal filter, the optimization of the useful signal, the error signal between the useful signal and the estimated useful signal, or more precisely between the estimated power spectral densities of these signals, being available directly on account of the optimal filtering carried out. For this reason, the global filtering is represented by dashes as the union of steps 103 and 104 in FIG. 2*c*.

Of course, in the case in which the disturbing signal p(t) consists, not only of the contribution of a noise signal, as described in relation to FIG. 2*c*, but also of the contribution of a reception signal, and, in a manner similar to the corresponding mode of processing represented in FIG. 2*b*, the method, which is the subject of the present invention, for a processing in the frequency domain, can of course be implemented with the same advantages as in the case of FIG. 2*c* in the case of the presence of a reception signal, as represented in FIG. 2*d*.

In this case, the method, which is the subject of the present invention, consists in performing a frequency transform of the observation signal, in step 100*a*, which transform is denoted FFT, so as to generate the transformed signal representative in the frequency domain of the observation signal Y(f) as well as a frequency transform of the reception signal, in step 100*b*, so as to generate a transformed signal representative of the reception signal and dentoed X(f).

In a manner similar to the procedure described in FIG. 2*c*, an estimation step is performed in steps 100*a* and 100*b*, this estimation step consisting, on the basis of each transformed signal Y(f) and X(f) mentioned above, in obtaining a signal representative of the estimated power spectral density of the observation signal, for this reason denoted $\hat{\gamma}_{yy}(f)$, respectively of the reception signal, for this reason denoted $\hat{\gamma}_{xx}(f)$.

Generally, the estimation of the power spectral density of the observation signal, of the reception signal and of the echo signal can be implemented by means of a recursive filtering using a neglect factor, as will be described later in the description.

The estimation of the power spectral density of the disturbing signal performed in step 101 consists in performing the step for estimating the power spectral density of the disturbing signal $\hat{\gamma}_{pp}(f)$ on the signal representative of the power spectral density of the observation signal $\hat{\gamma}_{yy}(f)$ available at the end of step 100*a*, respectively on the signal representative of the power spectral density of the reception signal $\hat{\gamma}_{xx}(f)$ available at the end of step 100*b*. Thus, signals representative of the estimated power spectral density of the noise signal, which signal is denoted $\hat{\gamma}_{ppy}(f)$, respectively of the echo signal generated by the reception signal for this reason denoted $\hat{\gamma}_{ppx}(f)$, are obtained at the end of steps 101*a* and 101*b*, that is to say finally at the end of step 101.

By virtue of the same principle of the absence of correlation between the contribution of the noise to the disturbing signal and the useful signal and the contribution of the noise to the disturbing signal and the contribution of the reception signal to this same disturbing signal and this same useful signal, the resulting estimated power spectral density of the disturbing signal, hence denoted $\hat{\gamma}_{pp}(f)$, supposedly consists of the sum of the estimated power spectral densities $\hat{\gamma}_{ppy}(f)$ and $\hat{\gamma}_{ppx}(f)$.

By virtue of the uniqueness of notation used for the description of FIGS. 2*d* and 2*c*, step 102 as represented in FIG. 2*d* also consists in performing an estimation of the spectral density of the useful signal $\hat{\gamma}_{ss}(f)$ which is then supposedly equal to the difference of the estimated spectral densities of the observation signal $\hat{\gamma}_{yy}(f)$ and of the disturbing signal $\hat{\gamma}_{pp}(f)$.

Of course, and just as in the case of FIG. 2*c*, the estimated spectral density signals of the useful signal $\hat{\gamma}_{ss}(f)$ available in step 102 and of the disturbing signal $\hat{\gamma}_{pp}(f)$ then make it possible to carry out the optimal filtering in step 103 and, more generally, the global filtering 103+104 on the signal Y(f) representative in the frequency domain of the observation signal.

As far as the criterion for minimizing the error between the useful signal and the estimated useful signal is concerned, it is indicated that the minimization criterion can consist in minimizing the mean square error of estimation according to relation (1):

$$E[(su-\hat{s}u)^2]$$

The aforementioned relation (1) can be used, either for the processing in the time domain or for the processing in the frequency domain.

A justification for the complete method of optimized processing, which is the subject of the present invention, will now be given from the theoretical standpoint for a processing in the frequency domain.

Minimization of the aforementioned error between the useful signal and the estimated useful signal leads, for the frequency domain, to the implementation of a filtering of the observation signal in the form thereof of a signal representative of the observation signal in the frequency domain Y(f), according to relation (2):

$$\hat{S}(f)=T(f)Y(f)=su.$$

In this relation, T(f) represents the frequency response of an optimal filtering, the expression for which is given by relation (3):

$$T(f)=\frac{\hat{\gamma}_{ys}(f)}{\hat{\gamma}_{yy}(f)}.$$

In this relation,

- $\hat{\gamma}_{ys}(f)$ designates the cross-spectrum between the observation signal, that is to say the signal representative of the observation signal in the frequency domain and the useful signal, and
- $\hat{\gamma}_{yy}(f)$ designates the estimated power spectral density, hereafter designated psd, of the observation signal.

In view of the abovementioned realistic assumptions of the effective non-correlation between the useful signal and the disturbing signal consisting of noise and echo, the frequency response of the optimal filtering satisfies relation (4):

$$T(f)=\frac{\hat{\gamma}_{ss(f)}}{\hat{\gamma}_{ss}(f)+\hat{\gamma}_{pp}(f)}$$

In this relation:

- $\hat{\gamma}_{ss}(f)$ designates the estimated power spectral density of the useful signal,
- $\hat{\gamma}_{pp}(f)$ designates the estimated power spectral density of the disturbing signal.

From a practical point of view, the estimated power spectral density of the useful signal $\hat{\gamma}_{ss(f)}$ is not known a priori. This signal can for example be estimated in the light of the above assumptions of the non-correlation between the useful signal and the disturbing signal by using the previously mentioned spectral subtraction procedure, satisfying relation (5):

$$\hat{\gamma}_{ss}(f)=\hat{\gamma}_{yy}(f)-\hat{\gamma}_{pp}(f).$$

The procedure for the optimized processing of the disturbing signal, in accordance with the subject of the present invention, thus reduces to the implementing of a single optimal filtering, this allowing a global reduction of all the components making up the disturbing signal. Indeed, it is understood in particular that the disturbing signal may consist of a plurality of components provided that the non-correlation is sufficient between the useful signal and the disturbing signal, that is to say each of the components making up the latter. This assumption is largely satisfied in the various applications related for example to hands-free telephony in motor vehicles, or else to hands-free video conferencing, and, more generally, to any type of application in which a plurality of components of a disturbing signal can be demonstrated.

In such a case, for a disturbing signal consisting of a plurality of components of this disturbing signal, the estimated power spectral density of the disturbing signal $\hat{\gamma}_{pp}(f)$ is then taken equal to the sum of the estimated power spectral densities $\hat{\gamma}^{i}_{pp}(f)$ of each component of rank i of this disturbing signal. In this case, the signal representative of the estimated power spectral density of the disturbing signal satisfies relation (6):

$$\hat{\gamma}_{pp}(f)=\sum_{i=1}^{P}\gamma^{i}_{pp}(f).$$

In this relation, P represents the number of components of the disturbing signal.

A preferred embodiment of the method of optimized processing, which is the subject of the present invention, will now be described in conjunction with FIG. 2*e* in the case in which a block processing of the observation signal is carried out.

Within the framework of such processing, it is understood in particular that the observation signal y(t) available is of course sampled at a suitable sampling frequency, the successive samples being subdivided into blocks of samples. Each sample block is assigned a successive rank m, where m in fact designates the rank of the current block subjected to the processing. It is understood in particular that the technique for constructing the sample blocks is a conventional technique, the successive blocks of samples possibly being subject to some overlap typically equal to 50% in terms of the number of samples making up each block.

Within the framework of FIG. 2*e*, the block processing is supposedly performed in the most general way when the disturbing signal takes into account not only the contribution of a noise signal, but also that generated by a reception signal x(t).

As represented in FIG. 2*e*, in step 100*a*, in addition to the subdivision of the observation signal into successive blocks of rank m, each sample block being denoted Bm(t) is of course subjected to an FFT frequency transformation making it possible to obtain sample blocks in the frequency domain, denoted Bm(f). Step 100*a* also consists in performing an estimation of the power spectral density of the observation signal over the current block, the estimated power spectral density of the observation signal being denoted $\hat{\gamma}_{yy}(f,m)$ where m of course denotes the index relating to the current block.

At the end of step 100*a* we in fact have not only the signal representative of the estimated power spectral density of the aforementioned observation signal $\hat{\gamma}_{yy}(f,m)$, but also the block Bm(f) representative of the observation signal for the current block of rank m under consideration.

The same goes for step 100*b* for which, by analogy with FIG. 2*d*, a corresponding processing is applied to the reception signal x(t), this processing then consisting in a subdivision into corresponding blocks of rank m, each block being denoted B'm(t), each aforementioned block being subjected to a frequency transformation, denoted FFT, this operation making it possible to obtain blocks representative of the sample blocks in frequency space and for this reason denoted B'm(f). Step 100*b* represented in FIG. 2*e* also includes an operation for estimating the power spectral density of the reception signal over the current block B'm(f). At the end of step 100*b* of FIG. 2*e* we have each current block B'm(f) representative of the sample block in the frequency domain and a signal representative of the estimated power spectral density of the reception signal for the aforementioned current block, this signal being denoted $\hat{\gamma}_{xx}(f,m)$.

As represented moreover in FIG. 2*e*, the method of optimized processing, in accordance with the subject of the present invention, then consists, in step 101, in performing an estimation of the power spectral density of each component of the aforementioned disturbing signal $\hat{\gamma}^{i}_{pp}(f,m)$. It is understood for example that the signal representative of the power spectral density of each component of the disturbing signal $\hat{\gamma}^{i}_{pp}(f,m)$ is in fact made up at least of the signal representative of the estimated power spectral density $\gamma_{ppy}(f,m)$ representative of the contribution of the noise signal to the disturbing signal and of the signal representative of the estimated power spectral density of the contribution of the reception signal to this disturbing signal $\hat{\gamma}_{ppx}(f,m)$.

The power spectral density of each component of the disturbing signal $\hat{\gamma}^{i}_{pp}(f,m)$ is estimated in this way on the basis of the reception signal and, more particularly, on the basis of the estimated power spectral density of the reception signal $\hat{\gamma}_{xx}(f,m)$ and of the current block B'm(f), of the estimation of the power spectral density of the observation signal over the current block Bm(f) of the observation signal of like rank m.

At the end of step 101, in FIG. 2*e* we in fact have, for the current block of rank m of the observation signal and of the reception signal, the estimated power spectral density of the observation signal over this current block denoted $\hat{\gamma}_{yy}(f,m)$ and, of course, an estimation of the power spectral density of the disturbing signal $\hat{\gamma}_{pp}(f,m)$, which of course satisfies the aforementioned relation (6).

As represented in FIG. 2*e*, the power spectral density of the useful signal is then estimated over the current block by a so-called a-posteriori estimation. The signal representative of the estimated power spectral density of the useful signal then satisfies relation (7):

$$\hat{\gamma}_{ss-post}(f,m)=\hat{\gamma}_{yy}(f,m)-\sum_{i=1}^{P}\hat{\gamma}^{i}_{pp}(f,m).$$

It is recalled that the concept of a-posteriori estimation embraces the concept of the estimation of the power spectral density of the useful signal in the absence of any knowledge regarding the latter. This peration bears the reference 102*a* in FIG. 2*e*.

The a-posteriori estimation operation 102*a* is then followed by a step 102*b* of a-priori estimation of the amplitude of the spectrum of the useful signal over the current block. Generally, it is indicated that the amplitude of the spectrum of the useful signal over the current block satisfies the general relation (8):

$$A_{ss}(f,m)=T(f,m)\cdot Y(f,m).$$

In this relation:

T(f,m) designates the frequency response of the optimal filtering for the current block;

Y(f,m) designates the short-term frequency transform, that is to say the Fourier transform, over the current block of the observation signal.

It is indicated in particular that the signal Y(f,m) can be obtained from the current block Bm(t) and application of a straightforward short-term Fourier transform over this current block serves to obtain the signal Y(f,m).

In order to carry out a-priori estimation of the amplitude of the spectrum of the useful signal, it is indicated that this operation, carried out in step 102*b*, consists in taking as value the signal corresponding to the filtering of the current block of the observation signal by storing in memory the value, computed over the preceding block, of the frequency response of the optimal filtering that is to say T(f,m−1), according to relation (9):

$$A_{ss}(f,m)=T(f,m-1)\cdot Y(f,m).$$

It is thus understood that the estimation step 102*b* can be summarized as the storing in memory of the value, computed over the preceding block, of the frequency response of the optimal filtering.

The aforementioned step 102*b* is then followed by the estimation of the power spectral density of the useful signal in step 102*c* represented in FIG. 2*e*. In the aforementioned step 102*c* the estimated power spectral density of the useful signal is derived in such a way as to satisfy the following relation (10):

$$\hat{\gamma}_{ss}(f,m)=\beta(m)=A_{ss}(f,m)=^{2}+(1-\beta(m))\hat{\gamma}_{ss-post}(f,m).$$

Step 102*c* for estimating the power spectral density of the useful signal is carried out by implementing a step 102*d* making it possible to generate, for each current block Bm(f), a weighting parameter β(m) making it possible to assign a matched weight between the current estimation carried out on the basis of the filtering applied to the preceding block of rank m−1 and the contribution in respect of the current frame of the estimated power spectral density of the useful signal, which is of course represented by the signal $\hat{\gamma}_{ss-post}(f,m)$.

At the end of step 102 we have of course the signal representative of the estimated power spectral density of the useful signal, denoted $\hat{\gamma}_{ss}(f,m)$. The optimal filtering procedure can then be steered in respect of the current block to the signal Y(f,m) by virtue of the global filtering described earlier in conjunction with FIG. 2*d* in steps 103 and 104. Of course, the transition to the next block is carried out via the incrementation m=m+1 represented in FIG. 2*e*.

A more detailed description of a non-limiting embodiment of a device for the optimized processing of a disturbing signal during a sound capture on the basis of an observation signal, this signal being formed of a useful signal and of this disturbing signal, will now be described in conjunction with FIGS. 3*a* and 3*b*.

More specifically and on account of the major advantages mentioned earlier in the description with regard to the frequency processing, the device, which is the subject of the present invention, represented in FIG. 3*a*, will be described for such a processing.

Furthermore, the disturbing signal is regarded as consisting of noise and of an echo generated by a reception signal. In the same way as in the case of FIGS. 2*c* and 2*d*, the observation signal is denoted y(t) and is regarded as originating from a microphone M, and the reception signal denoted x(t) corresponds to that of the signal delivered to a loudspeaker LS within the context of hands-free mobile radio telephony for example. It is thus understood that within the interior of the vehicle, the loudspeaker LS and the microphone M necessarily being close to one another, the reception signal's contribution to the disturbing signal can in no case be neglected, whereas of course other components such as the noise of the vehicle engine, the roadway noise generated by nearby traffic for example constitute so many components and contributions to the disturbing signal.

The description of FIG. 3*a* and of FIG. 3*b* is given in the case of the general principle of global processing as well as in the case of a similar processing carried out in the form of block processing, the references of the elements making up the optimized processing device, which is the subject of the present invention, in the case of block processing, corresponding to those allocated in respect of the general processing, although assigned an index m corresponding to the rank designation of the current block under consideration, as described earlier in conjunction with FIG. 2*d* and 2*e*.

As it has been represented in FIG. 3*a*, the observation signal y(t) delivered by the microphone M is subjected by means of a module, denoted $T_1(f,m)$, $T_1(f)$, to digital sampling at an appropriate frequency, to block subdivision and of course to a frequency transform, denoted FFT in FIG. 3*a*. The module $T_1(f,m)$ then delivers the signal Y(f,m) representative in the frequency domain of the observation signal over the block of rank m under consideration.

The same is true in respect of the reception signal via a module $T_2(f,m)$, $T_2(f)$, which makes it possible to deliver the representative signal in the frequency domain X(f,m) and the blocks B'm(f) representative of the reception signal for the block of rank m under consideration.

The modules $T_1(f,m)$ and $T_2(f,m)$ are identical modules of the conventional type, synchronized by the same clock signal (not represented). In this respect, these modules will not be described in detail since they correspond to modules which are normally used in the corresponding technical field and, in this respect, are wholly known to those skilled in the art.

As will be observed in FIG. 3*a* moreover, the optimized processing device, which is the subject of the present invention, comprises a module $\mathbf{1},\mathbf{1}_m$ for estimating the power spectral density of the observation signal and which delivers, on the basis of this observation signal, or, more precisely, on the basis of the signal representative in the frequency domain of this observation signal, that is to say either the signal Y(f) or the signal Y(f,m), a digital signal representative of the estimated power spectral density of the observation signal and therefore denoted, for the same reason, $\hat{\gamma}_{yy}(f)$, respectively $\hat{\gamma}_{yy}(f,m)$ over the current block m under consideration.

Moreover, the device according to the invention and as represented in FIG. 3*a* comprises a module $\mathbf{2},\mathbf{2}_m$ for estimating the power spectral density of the disturbing signal which receives the reception signal, or, more precisely, the signal representative in the frequency domain of this reception signal, that is to say either the signal X(f,m) or the signal X(f). The module 2 for estimating the power spectral density of the disturbing signal also receives the digital signal representative of the estimated power spectral density of the observation signal, that is to say the signal $\hat{\gamma}_{yy}(f)$, respectively $\hat{\gamma}_{yy}(f,m)$. As a consequence it delivers a digital signal representative of the estimated power spectral density of the disturbing signal, denoted $\hat{\gamma}_{pp}(f)$. In a particular non-limiting embodiment, it is indicated that the module $\mathbf{2},\mathbf{2}_m$ in fact delivers all the signals representative of the estimated power spectral density of the components of the disturbing signal and denoted $\hat{\gamma}^i_{pp}(f)$, respectively $\hat{\gamma}^i_{pp}(f,m)$.

A module $\mathbf{3},\mathbf{3}_m$ for estimating the power spectral density of the useful signal is also provided, which receives the digital signal representative of the estimated power spectral density of the observation signal $\hat{\gamma}_{yy}(f)$, repsectively $\hat{\gamma}_{yy}(f,m)$ delivered by the module $\mathbf{1},\mathbf{1}_m$ as well as the digital signal representative of the estimated power spectral density of the disturbing signal $\hat{\gamma}_{pp}(f)$, respectively $\hat{\gamma}_{pp}(f,m)$ or the components of the latter, as mentioned previously. The module $\mathbf{3},\mathbf{3}_m$ for estimating the power spectral density of the useful signal delivers, by a procedure inspired by the general principle of the spectral subtraction of a digital signal, denoted $\hat{\gamma}_{ss}(f)$, respectively $\hat{\gamma}_{ss}(f,m)$ representative of the estimated power spectral density of the aforementioned useful signal.

Finally, the device for the optimized processing of a disturbing signal, which is the subject of the present invention, as represented in FIG. 3*a*, comprises a global filtering module, denoted $\mathbf{4},\mathbf{4}_m$, making it possible to carry out optimal filtering of the signal representative in the frequency domain of the observation signal, that is to say the signal Y(f) respectively Y(f,m) delivered by the module $T_1(f,m)$, $T_1(f)$.

As represented more specifically in FIG. 3*a*, the filtering module $\mathbf{4},\mathbf{4}_m$ advantageously comprises a module, denoted $\mathbf{4}a,\mathbf{4}a_m$, for computing the coefficients of an optimal filter which receives the digital signal representative of the estimated power spectral density of the disturbing signal $\hat{\gamma}_{pp}(f)$, respectively $\hat{\gamma}_{pp}(f,m)$, as well as the digital signal representative of the estimated power spectral density of the useful signal $\hat{\gamma}_{ss}(f)$, respectively $\hat{\gamma}_{ss}(f,m)$. The module $\mathbf{4}a,\mathbf{4}a_m$ represented in FIG. 3*a* delivers a filtering adaptation digital signal, denoted af, representative of an optimal-filtering frequency response, satisfying relation (4) given earlier in the description. It is of course understood that in this relation, the estimated power spectral density of the disturbing signal corresponds to the sum of the spectral densities of the components of the disturbing signal according to relation (6) given previously in the description.

Finally, a module $\mathbf{4}b,\mathbf{4}b_m$, a constituent of the global filtering module $\mathbf{4},\mathbf{4}_m$, receives the signal representative of the frequency response, that is to say the signal af delivered by the module $\mathbf{4}a,\mathbf{4}a_m$ and delivers, on the basis of the signal representative in the frequency domain of the observation signal, the useful signal su. It is understood in particular that the optimal filtering module $\mathbf{4}b,\mathbf{4}b_m$ can consist for example of a Wiener filtering module. The signal delivered by this filtering module $\mathbf{4}b,\mathbf{4}b_m$ is then received by a module for inverse frequency transform, for this reason denoted $FFT^{-1}$, and for block synthesis, bearing the reference $\mathbf{5},\mathbf{5}_m$, which delivers, on the basis of the optimal filtering signal, the useful signal proper su(t) reconstructed in the time domain.

A more detailed description of a preferred embodiment of the module $\mathbf{3}_m$ represented in FIG. 3*a* for estimating the power spectral density of the useful signal corresponding to the mode of implementation of the method, which is the subject of the present invention, as represented in FIG. 2*e*, will now be given in conjunction with FIG. 3*b* in respect of a processing by successive blocks of rank m.

Of course, and in accordance with the description given in conjunction with FIG. 3*a*, the device which is the subject of the present invention comprises, in addition to the module $T_1$(f,m) which delivers a succession of successive current blocks of rank m, the module for estimating the power spectral density of the observation signal over the current block $\hat{\gamma}_{yy}$(f,m), the module $\mathbf{1}_m$, and the module for estimating the power spectral density of each component of the disturbing signal $\hat{\gamma}^i_{pp}$(f,m), the module $\mathbf{2}_m$, the module for blockwise estimation of the power spectral density of the useful signal, the module $\mathbf{3}_m$, which advantageously comprises, as represented in FIG. 3*b*, a module $\mathbf{30}_m$ for a-posteriori estimation of the power spectral density of the useful signal over the current block, denoted $\hat{\gamma}_{ss\text{-}post}$(f,m) satisfying relation (7) mentioned previously in the description. Moreover, the module $\mathbf{3}_m$ also comprises a module $\mathbf{31}_m$ for a-posteriori estimation of the amplitude of the spectrum of the useful signal over the current block, satisfying relation (9) mentioned previously in the description. The module $\mathbf{31}_m$ receives, on the one hand, the signal $\hat{\gamma}_{ss\text{-}post}$(f,m) delivered by the module $\mathbf{30}_m$ as well as, on the other hand, the signal Y(f,m) delivered by the block $T_1$(f,m), as well as a signal representative of the frequency response of the optimal filtering for the block preceding the current block, i.e. T(f,m−1) delivered for example by the block $\mathbf{4}a_m$ of FIG. 3*a*.

Block $\mathbf{31}_m$ then delivers an a-priori estimation of the amplitude of the spectrum of the useful signal, denoted $A_{ss}$(f,m).

Finally, a module for computing the power spectral density of the useful signal, for the current block, the module $\mathbf{32}_m$, is provided, which receives the a-priori estimation signal for the amplitude of the spectrum of the useful signal $A_{ss}$(f,m) delivered by the module $\mathbf{31}_m$ as well as a signal representative of a coefficient or weighting parameter β(m) on the basis of a module $\mathbf{33}_m$ represented in FIG. 3*b*. The parameter β(m) makes it possible to assign a matched weight between the estimation made on the preceding block of rank m−1 and the contribution in respect of the current frame of the power spectral density of the useful signal, as mentioned previously in the description. The parameter β(m) can be tailored in accordance with the characteristics of the useful signals and of the estimated noise. The module $\mathbf{32}_m$ then delivers the signal representative of the estimated power spectral density of the useful signal, satisfying the relation (10) mentioned previously in the description.

The embodiment of the device for the optimized processing of a disturbing signal, which is the subject of the present invention, as represented in FIGS. 3*a* and 3*b*, is not limiting.

It is understood in particular that in conjunction with the context of FIG. 2*d* for example, for a disturbing signal formed by an echo signal of this reception signal and of a noise signal, when the noise signal is substantially uncorrelated with the echo signal and when the module for estimating the power spectral density of the echo signal $\mathbf{2},\mathbf{2}_m$ then delivers a digital signal representative of the estimated power spectral density of the echo signal, denoted $\hat{\gamma}_{zz}$(f,m), respectively $\hat{\gamma}_{zz}$(f,m), the device, which is the subject of the present invention, is modified according to FIG. 3*c* where, however, the same references represent the same elements as in the case of FIG. 3*a*.

With such an assumption and in view of the realistic assumption of non-correlation between the components of the disturbing signal, that is to say between the noise signal and the acoustic echo, the relation (4) mentioned previously in the description becomes relation (11):

$$T(f) = \frac{\hat{\gamma}_{ss(f)}}{\hat{\gamma}_{ss}(f) + \hat{\gamma}_{bb}(f) + \hat{\gamma}_{ZZ}(f)}$$

This relation represents the frequency response of the global filter in the light of the estimation of the power spectral density of the useful signal, of the noise signal and of the echo signal, which are denoted $\hat{\gamma}_{ss}$(f), respectively, $\hat{\gamma}_{bb}$(f,m), $\hat{\gamma}_{zz}$(f,m), with reference to FIG. 3*c*.

In the same way and by virtue of the same realistic assumptions of non-correlation between the components of the disturbing signal, relation (5) mentioned previously in the description is transformed into relation (12):

$$\hat{\gamma}_{zz}(f,m)=\hat{\gamma}_{yy}(f,m)-\hat{\gamma}_{bb}(f,m)-\hat{\gamma}_{zz}(f,m).$$

In an advantageous embodiment of the device for the optimized processing of a disturbing signal, which is the subject of the present invention, and within the more specific context of hands-free mobile telephony, an estimation of the power spectral density of the noise alone can be obtained in particular in the absence of any echo signal and useful signal.

In the same way, it is possible to estimate the power spectral density of the echo signal on the basis of the signal representative in the frequency domain of the reception signal and of the observation signal. By way of non-limiting example, this estimation can involve an estimation of the transfer function of the acoustic channel between the reception signal and the observation signal.

In view of the remarks above, in such a case the device, as represented in FIG. 3*c*, comprises, associated with the module $\mathbf{1},\mathbf{1}_m$ for estimating the power spectral density of the observation signal, an additional module for estimating the power spectral density of the noise affecting this observation signal.

In this case, moreover, as represented in FIG. 3*c*, the module $\mathbf{2},\mathbf{2}_m$ for estimating the power spectral density of the disturbing signal in fact constitutes a module for estimating the power spectral density of the acoustic echo, which delivers a signal representative of the estimated power spectral density of the acoustic echo, denoted $\hat{\gamma}_{zz}$(f,m).

Under these conditions the module for computing the coefficients of the optimal filter $\mathbf{4}a,\mathbf{4}a_m$, as represented in FIG. 3*c*, receives directly the signal representative of the estimated power spectral density of the acoustic echo $\hat{\gamma}_{zz}$(f, m), the signal representative of the estimated power spectral density of the noise, denoted $\hat{\gamma}_{bb}$(f,m) and, of course, the signal representative of the estimated power spectral density of the observation signal, denoted $\hat{\gamma}_{yy}$(f,m).

Under these conditions, and in view of the availability at the module $\mathbf{4}a,\mathbf{4}a_m$ of the aforementioned signals, that is to say:

- of the signal representative of the estimated power spectral density $\hat{\gamma}_{yy}$(f), respectively, $\hat{\gamma}_{yy}$(f,m), delivered by the module $\mathbf{1},\mathbf{1}_m$,
- of the signal representative of the estimated power spectral density of the noise $\hat{\gamma}_{bb}$(f) respectively $\hat{\gamma}_{bb}$(f,m),
- of the signal representative of the power spectral density $\hat{\gamma}_{zz}$(f), respectively $\hat{\gamma}_{zz}$(f,m) delivered by the module $\mathbf{2},\mathbf{2}_m$, the module $\mathbf{3},\mathbf{3}_m$ for estimating the power spectral density of the useful signal $\hat{\gamma}_{ss}$(f,m), respectively $\hat{\gamma}_{ss}$(f,m) is no longer indispensable, the signal representative of the estimated power spectral density of the useful signal then being given directly by relation (12). The frequency response of the optimal filter, the module 4b,4b$_m$, is then given by relation (11) by way of the signal af mentioned previously in the description.

In a specific embodiment of the device for the optimized processing of a disturbing signal, which is the subject of the present invention, as represented in FIG. 3c, it is indicated that the module 1a,1a$_m$ for estimating the spectral density of the noise signal can advantageously comprise, as represented in FIG. 3d, a module for detecting the absence of useful signal and the absence of echo signal in the observation signal, and a first-order recursive filter exhibiting a neglect factor $\lambda_{bb}$, this neglect factor consisting of a real coefficient lying between the value 0 and 1. In such a case, the recursive filter delivers the digital signal representative of the estimated power spectral density of the noise signal $\hat{\gamma}_{bb}$(f), respectively $\hat{\gamma}_{bb}$(f,m) satisfying relation (13):

$$\hat{\gamma}_{bb}(f,m)=\lambda_{bb}\cdot\hat{\gamma}_{bb}(f,m-1)+(1-\lambda_{bb})\ (=b\ (f,m)=^2).$$

In the aforementioned relation (13) it is indicated that b(f,m) designates the frequency transform, the Fourier transform, of the observation signal as derived over a current time segment of the observation signal in the absence of voice activity, that is to say of speech by one or other of the two communicating speakers. As will be observed in FIG. 3d, the estimation module 1$_{am}$, in its version relating to block processing, described in non-limiting fashion, comprises the voice activity detection module 10$_{am}$ which receives for example the signal Y(f,m) delivered by the module $T_1$(f,m), a switch 11$_{am}$ controlled by the voice activity detector module 10$_{am}$, a squaring module 12$_{am}$, a multiplier circuit 13$_{am}$ which receives the signal delivered by the squaring module 12$_{am}$ and the value $1-\lambda_{bb}$. A summator 14$_{am}$ receives the signal delivered by the module 12$_{am}$, delivers the signal representative of the estimated power spectral density of the noise signal $\hat{\gamma}_{bb}$(f,m) and receives via a feedback loop the signal representative of the estimated power spectral density of the noise signal $\hat{\gamma}_{bb}$(f, m−1) relating to the block preceding the current block by way of a delay module 15$_{am}$, a memory for example, and of a weighter multiplier module 16$_{am}$ which receives the value $\lambda_{bb}$. On detection of absence of voice activity, the block $B_m$(f) delivered by the module $T_1$(f,m) corresponds to the frequency transform b(f,m) of the noise signal.

Finally, as far as the module for estimating the power spectral density of the observation signal is concerned, in particular the model 1,1$_m$, it is indicated that the latter can comprise, as represented in FIG. 3e, a first-order recursive filter exhibiting a neglect factor $\lambda_{yy}$ consisting of a real coefficient lying between 0 and 1. The aforementioned recursive filter then delivers the digital signal representative of the estimated power spectral density of the observation signal $\hat{\gamma}_{yy}$(f), respectively $\hat{\gamma}_{yy}$(f,m), satisfying relation (14):

$$\hat{\gamma}_{yy}(f)=\hat{\gamma}_{yy}\cdot\hat{\gamma}_{yy}(f)+(1-\lambda_{yy})\cdot=Y(f)=^2.$$

In this relation, Y(f), respectively Y(f,m), designates the signal representative in the frequency domain of the observation signal, that is to say the frequency transform of this observation signal over the current block for example.

The recursive filter represented in FIG. 3e includes elements similar to those represented in FIG. 3d, the notation am being modified to m respectively, the value $\lambda_{yy}$ being adapted accordingly.

FIGS. 4a to 4e make it possible to evaluate the performance obtained by implementing the method for processing an optimized disturbing signal and by means of a device, in accordance with the subject of the present invention, as represented for example in FIG. 3c.

In FIGS. 4a, 4b and 4c, the abscissa axis is graduated in seconds and the ordinate axis in terms of PCM digital coding amplitude value, coding on 16 bits corresponding to a maximum value of 32,768.

The application context related to hands-free radio telephony in a motor vehicle.

The signal sampling frequency was a value of 8 kHz, the digital coding of the samples which is thus obtained being based on the PCM format, i.e. 16 linear bits.

In the course of these trials, the signal broadcast over the loudspeaker, or reception signal, and the microphone signal, that is to say the observation signal, were recorded synchronously, the engine of the vehicle being off.

Within the framework of this evaluation, noise and local speech signals recorded separately in the same vehicle have been summed artificially with the echo signal.

The original echo signal, picked up by the microphone M, is represented in FIG. 4a.

The noise-affected observation signal, obtained in the way mentioned earlier, is represented in FIG. 4b, when the local speech, that is to say from the talker in the vehicle, was artificially disturbed by a noise signal and an echo signal corresponding to a man's voice.

In FIGS. 4a and 4b the signal represented in the form of rectangular pulses under the aforementioned recordings represents the detection of voice activity at reception, that is to say in the reception signal received by the loudspeaker LS.

The test observation signal represented in FIG. 4b thus includes noise periods alone, echo periods alone within the noise, and also periods of double-talk, during which periods the two conversing parties are speaking simultaneously. The test signal corresponds to a typical case in a hands-free mobile radio context.

The characteristics of the observation signal are given in the table below:

| | |
|---|---|
| Mean signal-to-echo ratio (dB) | 9.00 |
| Maximum signal-to-echo ratio (dB) | 38.61 |
| Minimum signal-to-echo ratio (dB) | −23.66 |
| Standard deviation of the signal-to-echo ratio (dB) | 5.31 |
| Mean signal-to-noise ratio (dB) | 6.17 |
| Maximum signal-to-noise ratio (dB) | 19.18 |
| Minimum signal-to-noise ratio (dB) | −27.38 |
| Standard deviation of the signal-to-noise ratio (dB) | 5.21 |

In the course of these trials, in addition to the aforementioned sampling frequency, the processing parameters were as follows:

length of the analysis window: 256 samples;

type of analysis window: Hanning window;

overlap: 50%, i.e. 128 samples;

number of points of the fast Fourier transform FFT: 256 points;

linear convolution constraint for the filtering carried out by inverse FFT on 512 points;

method of signal synthesis: OLA standing for the Overlapp Add method.

FIG. 4c represents the useful signal obtained at the output of the device, the signal su of FIG. 3c. An effective reduction is noted in the influence of the disturbing signal picked up during sound capture. The noise and the starting echo signal are highly attenuated by applying the processing.

In order to evaluate the reduction afforded by the processing on the noise and on the echo, FIGS. 4*d* and 4*e* represent, on the one hand, the attenuation of the echo in decibels and, on the other hand, the attenuation of the noise in decibels.

The attenuation of the echo is evaluated by an energy measurement, known by the name ERLE standing for Echo Return Loss Enhancement, this measurement being evaluated over blocks of 256 samples in the absence of overlap.

In the same way, the attenuation of the noise is evaluated over blocks of 256 samples with no overlap.

The analysis of FIGS. 4*d* and 4*e* shows that the method and the device for optimized processing, which are the subject of the present invention, make it possible to reduce the mean power of the acoustic echo picked up by the microphone M, by the order of 15 dB during the echo periods alone and by the order of 10 dB during the double-talk periods.

As far as the reduction in the mean noise power is concerned, this reduction is of the order of 18 dB during the period of noise alone. During the echo periods alone and the double-talk periods, the optimized global processing adapts automatically to the observation signal delivered by the microphone M. Indeed, it is then possible to note a noise power reduction of 15 dB during echo periods alone and of 8 dB during double-talk periods.

The method and the device for the optimized processing of disturbing signals, which are the subjects of the present invention, appear to be very advantageous insofar as they make it possible to reduce the distortions introduced into the useful local speech signal. Moreover, the reduction in the attenuation afforded to the echo signal and to the noise signal during the periods of voice activity in transmission does not introduce undesirable effects on the signal transmitted to the distant party, since the echo signal and the residual noise signal surviving after processing are then subjectively masked by the local speech signal.

The method and the device, which are the subjects of the present invention, are particularly well suited to hands-free mobile radio telephony in motor vehicles. Indeed, although certain European countries have already taken measures banning the use of a conventional portable telephone handset while driving a motor vehicle, a generalization of such measures is to be expected. Analysis of hands-free telephony in vehicles has demonstrated the two main nuisance factors for the driver, corresponding not only to simultaneous driving and communication, but also to the ambient noise level, whereas for the other party, the most significant nuisance is generated by the presence of noise and of an acoustic echo, which is induced by the acoustic coupling which exists between transducers.

By employing global processing of the disturbing signal, the method and the device, which are the subjects of the invention, whilst ensuring adequate quality of speech, make it possible to dispense with the implementing of an adaptive system for acoustic echo cancellation, the setting up of which proves to be particularly expensive and difficult to control.

What is claimed is:

1. A method of optimized processing of a disturbing signal consisting at least of a noise signal during a sound capture, on the basis of an observation signal formed of an original useful signal and of said disturbing signal, wherein, for a processing of said disturbing signal in the frequency domain, said method consists in performing:

a frequency transform of said observation signal so as to generate a first transformed signal which is representative, in the frequency domain, of said observation signal;

an estimation of said disturbing signal so as to generate an estimated disturbing signal;

an estimation of said original useful signal so as to generate an estimated useful signal, estimation of said original useful signal being performed by estimating on the basis of said first transformed signal a signal representative of the power spectral density of said observation signal;

a filtering of said observation signal on the basis of said estimated disturbing signal and of an optimal filtering so as to generate a useful signal, said optimal filtering being applied to said signal representative of the power spectral density of said observation signal so as to minimize the error between said useful signal and said estimated useful signal, said estimated useful signal converging towards said original useful signal for a substantially zero error between said useful signal and said estimated useful signal.

2. The method according to claim 1, wherein, when said sound capture is performed in the presence of a reception signal, said estimation of the disturbing signal consists in performing a separate estimation of the contribution of said reception signal and of the contribution of the noise signal of said disturbing signal, said separate estimation consisting in performing:

a frequency transform of said reception signal, so as to generate a second transformed signal which is representative, in the frequency domain, of said reception signal, an estimation as a contribution to said estimated disturbing signal on the basis of said second transformed signal so as to generate a signal representative of the power spectral density of said reception signal.

3. The method according to claim 1, wherein said optimal filtering is carried out on the basis of a signal representative of the estimated power spectral density of said useful signal, derived via a spectral subtraction procedure and satisfying the relation:

$$\hat{\gamma}_{ss}(f)=\hat{\gamma}_{yy}(f)-\hat{\gamma}_{pp}(f)$$

in which:

$\hat{\gamma}_{yy}(f)$ designates the estimated power spectral density of said observation signal;

$\hat{\gamma}_{pp}(f)$ designates the estimated power spectral density of said disturbing signal.

4. The method according to claim 1, wherein, for a disturbing signal consisting of a plurality of components of said disturbing signal, the estimated power spectral density of said disturbing signal $\hat{\gamma}_{pp}(f)$ is taken equal to the sum of the estimated power spectral densities $\hat{\gamma}^{i}_{pp}(f)$ of each component of rank i of said disturbing signal and satisfies the relation:

$$\hat{\gamma}_{pp}(f)=\sum_{i=1}^{P}\hat{\gamma}^{i}_{pp}(f)$$

where P represents the number of components of said disturbing signal.

5. The method according to claim 3, wherein, for a block processing operation in the frequency domain of said observation signal, said signal being subdivided into blocks of successive samples, said method, for every current block of rank m, with a view to deriving said estimated power spectral density of said useful signal, consists in performing:

an estimation of the power spectral density of said observation signal over the current block $\hat{\gamma}_{yy}(f,m)$;

an estimation of the power spectral density of each component of said disturbing signal $\hat{\gamma}^{i}_{pp}(f,m)$, on the basis of said reception signal, of the current block of rank m of said observation signal and of the estimation of the power spectral density of said observation signal over the current block $\hat{\gamma}_{yy}(f,m)$;

an a-posteriori estimation of the power spectral density of said useful signal over the current block, $\hat{\gamma}_{ss\text{-}post}(f,m)$ satisfying the relation:

$$\hat{\gamma}_{ss-post}(f,m)=\hat{\gamma}_{yy}(f,m)-\sum_{i=1}^{P}\hat{\gamma}^{i}_{pp}(f,m)$$

an a-priori estimation of the amplitude of the spectrum of said useful signal over the current block satisfying the relation:

$$A_{ss}(f,m)=T(f,m-1)\cdot Y(f,m)$$

where

T(f,m−1) designates the frequency response of said optimal filtering applied to the preceding block;

Y(f,m) designates the short-term Fourier transform, over the current block, of said observation signal, said estimated power spectral density of said useful signal satisfying, for the current block, the relation:

$$\hat{\gamma}_{ss}(f,m)=\beta(m)=A_{ss}(f,m)=^{2}+(1-\beta(m))\hat{\gamma}_{ss\text{-}post}(f,m)$$

in which relation β(m) designates, for said current block, a weighting parameter making it possible to assign a matched weight between a current estimation performed on the basis of a filtering applied to the preceding block, of rank m−1, and the contribution in respect of the current frame of the power spectral density of said useful signal.

6. A device for optimized processing of a disturbing signal during a sound capture, on the basis of an observation signal, formed of a useful signal and of said disturbing signal, said disturbing signal consisting of a noise and an echo generated by a reception signal, wherein, for a processing operation in the frequency domain of these signals, said device comprises at least:

means for estimating the power spectral density of said observation signal which deliver, on the basis of said observation signal, a digital signal representative of the estimated power spectral density of said observation signal $\hat{\gamma}_{yy}(f)$;

means for estimating the power spectral density of said disturbing signal which receive said reception signal and said digital signal representative of the estimated power spectral density of said observation signal $\hat{\gamma}_{yy}(f)$ and deliver a digital signal representative of the estimated power spectral density of said disturbing signal $\hat{\gamma}_{pp}(f)$;

means for estimating the power spectral density of said useful signal which receive said digital signal representative of the estimated power spectral density of said observation signal $\hat{\gamma}_{yy}(f)$ and said digital signal representative of the estimated power spectral density of said disturbing signal $\hat{\gamma}_{pp}(f)$ and deliver thus, via spectral subtraction, a digital signal representative of the estimated power spectral density of said useful signal $\hat{\gamma}_{ss}(f)$;

means for computing the coefficients of an optimal filter which receive said digital signal representative of the estimated power spectral density of said disturbing signal $\hat{\gamma}_{pp}(f)$ and said digital signal representative of the estimated power spectral density of said useful signal $\hat{\gamma}_{ss}(f)$ and deliver thus a filtering adaptation digital signal representative of a filtering frequency response of the form:

$$T(f)=\frac{\hat{\gamma}_{ss}(f)}{\hat{\gamma}_{ss}(f)+\hat{\gamma}_{pp}(f)};$$

means for optimal filtering which receive said observation signal and said filtering adaptation digital signal and deliver said estimated useful signal representative of said useful signal.

7. The device according to claim 6, wherein, for a disturbing signal consisting of a plurality of components of said disturbing signal, said means for estimating the power spectral density of said useful signal receive said digital signal representative of the estimated power spectral density of said observation signal $\hat{\gamma}_{yy}(f)$ and said digital signal representative of the estimated power spectral density $\hat{\gamma}^{i}_{pp}(f)$ of the various components of said disturbing signal and deliver thus a digital signal representative of the estimated power spectral density of said useful signal $\hat{\gamma}_{ss}(f)$.

8. The device according to claim 7, wherein, for a block processing operation in the frequency domain of said observation signal, said device comprises:

means for subdividing said observation signal into successive blocks which receive said observation signal and deliver a succession of successive current blocks of rank m;

means for estimating the power spectral density of said observation signal over a current block $\hat{\gamma}_{yy}(f,m)$;

means for estimating the power spectral density of each component of said disturbing signal $\hat{\gamma}^{i}_{pp}(f,m)$, on the basis of said reception signal, of said current block of rank m of said observation signal and of the estimation of the power spectral density of said observation signal over said current block $\hat{\gamma}_{yy}(f,m)$;

means of blockwise estimation of the power spectral density of said useful signal comprising:

means of a-posteriori estimation of the power spectral density of said useful signal over said current block, $\hat{\gamma}_{ss\text{-}post}(f,m)$ satisfying the relation:

$$\hat{\gamma}_{ss-post}(f,m)=\hat{\gamma}_{yy}(f,m)-\sum_{i=1}^{P}\hat{\gamma}^{i}_{pp}(f,m)$$

means of a-priori estimation of the amplitude of the spectrum of said useful signal over said current block satisfying the relation:

$$A_{ss}(f,m)=T(f,m-1).Y(f,m)$$

where

T(f,m−1) designates the frequency response of said optimal filtering applied to the preceding block;

Y(f,m) designates the short-term Fourier transform, over the current block, of said observation signal, said estimated power spectral density of said useful signal satisfying, for said current block, the relation:

$$\hat{\gamma}_{ss}(f,m)=\beta(m)=A_{ss}(f,m)=^{2}+(1-\beta(m))\hat{\gamma}_{ss\text{-}post}(f,m)$$

in which relation β(m) designates, for said current block, a weighting parameter making it possible to assign a matched weight between said current estimation performed on the basis of said filtering applied to the preceding block, of rank m−1, and the contribution to said current frame of the power spectral density of said useful signal.

9. The device according to claim 6, wherein, for a disturbing signal formed by an echo signal of said reception signal and of a noise signal, said noise signal being substantially uncorrelated from said echo signal and said means for estimating the power spectral density of said echo signal delivering a digital signal representative of the estimated power spectral density of said echo signal $\hat{\gamma}_{zz}(f)$, said device moreover comprises means for estimating the power spectral density of said noise signal which deliver to said means for computing the coefficients of an optimal filter a digital signal representative of the estimated power spectral density of said noise signal $\hat{\gamma}_{bb}(f)$, said means for computing delivering thus a filtering adaptation digital signal representative of a filtering frequency response of the form:

$$T(f) = \frac{\hat{\gamma}_{ss}(f)}{\hat{\gamma}_{ss}(f) + \hat{\gamma}_{bb}(f) + \hat{\gamma}_{zz}(f)}$$

with $$\hat{\gamma}_{ss}(f)=\hat{\gamma}_{yy}(f)-\hat{\gamma}_{bb}(f)-\hat{\gamma}_{zz}(f)\ .$$

10. The device according to claim 6, wherein said means for estimating the power spectral density of said observation signal comprise:

a first-order recursive filter having a neglect factor $\lambda_{yy}$, a real coefficient lying between 0 and 1, said first-order recursive filter delivering said digital signal representative of the estimated power spectral density of said observation signal $\hat{\gamma}_{yy}(f)$ of the form:

$$\hat{\gamma}_{yy}(f)=\lambda_{yy}\cdot\hat{\gamma}_{yy}(f)+(1-\lambda_{yy})\cdot=Y(f)=^2$$

where Y(f) represents the Fourier transform of the current time segment of said observation signal.

11. A device for optimized processing of a disturbing signal during a sound capture, on the basis of an observation signal, formed of a useful signal and of said disturbing signal, said disturbing signal consisting of a noise and an echo generated by a reception signal, wherein, for a block processing operation in the frequency domain of these signals, said device comprises at least:

means for subdividing said observation signal into successive blocks which receive said observation signal and deliver a succession of successive current blocks of rank m;

means for estimating the power spectral density of said observation signal over a current block $\hat{\gamma}_{yy}(f,m)$; and for a disturbing signal consisting of a plurality of components of said disturbing signal, means for estimating the power spectral density of each component of said disturbing signal $\hat{\gamma}^{i}_{pp}(f,m)$, on the basis of said reception signal, of said current block of rank m of said observation signal and of the estimation of the power spectral density of said observation signal over said current block $\hat{\gamma}_{yy}(f,m)$;

means of blockwise estimation of the power spectral density of said useful signal coprising:

means of a-posteriori estimation of the power spectral density of said useful signal over said current block, $\hat{\gamma}_{ss\text{-}post}(f,m)$ satisfying the relation:

$$\hat{\gamma}_{ss-post}(f,m) = \hat{\gamma}_{yy}(f,m) - \sum_{i=1}^{P} \hat{\gamma}^{i}_{pp}(f,m)$$

means of a-priori estimation of the amplitude of the spectrum of said useful signal over said current block satisfying the relation:

$$A_{ss}(f,m)=T(f,m-1)\cdot Y(f,m)$$

where

T(f,m−1) designates the frequency response of said optimal filtering applied to the preceding block;

Y(f,m) designates the short-term Fourier transform, over the current block, of said observation signal, said estimated power spectral density of said useful signal satisfying, for said current block, the relation:

$$\hat{\gamma}_{ss}(f,m)=\beta(m)=A_{ss}(f,m)=^2+(1-\beta(m))\hat{\gamma}_{ss\text{-}post}(f,m)$$

in which relation β(m) designates, for said current block, a weighting parameter making it possible to assign a matched weight between said current estimation performed on the basis of said filtering applied to the preceding block, of rank m−1, and the contribution to said current frame of the power spectral density of said useful signal;

means for computing the coefficients of an optimal filter which receive said digital signal representative of the estimated power spectral density of each component of said disturbing signal and said digital signal representative of the estimated power spectral density of said useful signal and deliver thus a filtering adaptation digital signal representative of a filtering frequency response;

means for optimal filtering which receive said observation signal and said filtering adaptation digital signal and deliver said estimated useful signal representative of said useful signal.

12. The device according to claim 11, wherein, for a disturbing signal formed by an echo signal of said reception signal and of a noise signal, said noise signal being substantially uncorrelated from said echo signal and said means for estimating the power spectral density of said echo signal delivering a digital signal representative of the estimated power spectral density of said echo signal $\hat{\gamma}_{zz}(f)$, said device moreover comprises:

means for estimating the power spectral density of said noise signal which deliver to said means for computing the coefficient of an optimal filter a digital signal representative of the estimated power spectral density of said noise signal $\hat{\gamma}_{bb}(f)$, said means for computing delivering thus a filtering adaptative digital signal representative of a filtering frequency response of the form:

$$T(f) = \frac{\hat{\gamma}_{ss}(f)}{\hat{\gamma}_{ss}(f) + \hat{\gamma}_{bb}(f) + \hat{\gamma}_{zz}(f)}$$

with $$\hat{\gamma}_{ss}(f)=\hat{\gamma}_{yy}(f)-\hat{\gamma}_{bb}(f)-\hat{\gamma}_{zz}(f),$$

said means for estimating the power spectral density of said noise signal comprising:

a means for detecting the absence of a useful signal and the absence of an echo signal in said observation signal;

a first-order recursive filter having a neglect factor $\lambda_{bb}$, a real coefficient lying between 0 and 1, said first-order recursive filter delivering said digital signal representative of the estimated power spectral density of said noise signal $\hat{\gamma}_{bb}(f)$ of the form:

$$\hat{\gamma}_{bb}(f,m)=\lambda_{bb}\cdot\hat{\gamma}_{bb}(f,m-1)+(1-\lambda_{bb})(=b(f,m)=^2)$$

where b(f,m) designates the Fourier transform of said observation signal, derived over a current time segment of said observation signal in the absence of voice activity.

* * * * *